US009038541B2

(12) United States Patent
Irion

(10) Patent No.: US 9,038,541 B2
(45) Date of Patent: May 26, 2015

(54) RAILROAD TIE REMOVAL MACHINE

(71) Applicant: Nordco Inc., Oak Creek, WI (US)

(72) Inventor: Allan Irion, Milwaukee, WI (US)

(73) Assignee: NORDCO INC., Oak Creek, WI (US)

( * ) Notice: Subject to any disclaimer, the term of this patent is extended or adjusted under 35 U.S.C. 154(b) by 0 days.

(21) Appl. No.: 14/482,905

(22) Filed: Sep. 10, 2014

(65) Prior Publication Data

US 2015/0007742 A1 Jan. 8, 2015

Related U.S. Application Data

(62) Division of application No. 13/936,067, filed on Jul. 5, 2013, now Pat. No. 8,863,667.

(51) Int. Cl.
*E01B 29/00* (2006.01)
*E01B 29/11* (2006.01)

(52) U.S. Cl.
CPC ..... *E01B 29/11* (2013.01)

(58) Field of Classification Search
CPC ..... E01B 29/00; E01B 29/10; E01B 29/11; E01B 29/32; E01B 31/23; E01B 27/025; E01B 27/026; E01B 27/04
See application file for complete search history.

(56) References Cited

U.S. PATENT DOCUMENTS

| | | | |
|---|---|---|---|
| 1,732,568 | A | 10/1929 | Robb |
| 2,097,430 | A | 11/1937 | Brown |
| 2,598,048 | A | 5/1952 | Gilmore |
| 2,603,255 | A | 7/1952 | Woolery |
| 3,128,808 | A | 4/1964 | Blix, Jr. |
| 3,190,324 | A | 6/1965 | Foxx |
| 3,210,046 | A | 10/1965 | Krause, Jr. |
| 3,240,162 | A | 3/1966 | Foxx |
| 4,018,165 | A | 4/1977 | Bryan, Jr. |
| 4,127,070 | A | 11/1978 | Dieringer et al. |
| 4,464,995 | A | 8/1984 | Nameny |
| 4,878,435 | A | 11/1989 | Theurer |
| 4,951,573 | A | 8/1990 | Madison |
| 5,651,317 | A | 7/1997 | Kim |
| 6,463,858 | B2 | 10/2002 | Weber et al. |
| 6,591,755 | B2 | 7/2003 | Theurer et al. |
| 6,755,135 | B2 | 6/2004 | Johnsen et al. |
| 7,497,166 | B2 | 3/2009 | Fuerst et al. |
| 7,578,239 | B1 | 8/2009 | Malek et al. |
| 2002/0121216 | A1 | 9/2002 | Theurer et al. |

*Primary Examiner* — Jason C Smith
(74) *Attorney, Agent, or Firm* — Greer, Bums & Crain, Ltd.

(57) ABSTRACT

A railroad tie removal machine for removing a railroad tie from beneath a pair of rails. The machine includes a movable frame, wherein when the frame is in a stationary location, a workspace is defined with respect to the stationary frame. A tie shear workhead and a kicker workhead are both mounted to the frame. The tie shear workhead includes two sets of shears configured and arranged to divide the tie into a center portion and two outer portions. The kicker workhead includes at least one kicker configured and arranged to outwardly kick corresponding outer portions of the cut tie from under the associated rail.

17 Claims, 24 Drawing Sheets

RAILROAD TIE REMOVAL MACHINE

This application is a divisional of U.S. patent application Ser. No. 13/936,067, filed Jul. 5, 2013.

BACKGROUND

The present invention relates generally to railroad maintenance equipment, and more particularly to an apparatus that removes railroad ties. Railroad ties, which are conventionally made of wood, deteriorate over time due to weather and other factors, or the ties may become damaged for a variety of different reasons. Thus, it becomes necessary to periodically remove the deteriorated or damaged ties from the railroad track, and to replace them with new ties.

In the past, railroad ties have been removed by using various types of machines that were designed for such a purpose. Generally, the tie removal machines were built to roll on a railroad track and to stop at a rail tie that needed replacement. One type of such a machine, disclosed in U.S. Pat. No. 6,463,858 includes an extending member that positions a gripping device normally relative to the track and adjacent to an end of the rail tie to remove it. The gripping device has vice-like jaws that clamp onto the end of the rail tie. Then, the extending member extends away from the track (in a direction normal to the track), thereby removing the tie from the track.

One example of another type of such a removal machine is the Fairmont W-114-C Tie Shear Machine, manufactured by Fairmont Railway Motors (now part of the Harsco Corporation). In this type of machine, two spaced pairs of jaws are lowered upon the railroad tie, with one pair of jaws being positioned on the inside of each of the rails. The jaws of each pair are closed, thereby cutting the tie at two locations on the inside of the rails, such that the tie is divided into three parts—a center part and two outer end parts. Next, the jaws are raised, while remaining closed, thereby lifting the centerpiece out of the way, leaving the two outer end pieces below their associated rail. Next, the entire Tie Shear Machine is moved along the track, so that a kicker apparatus is positioned above the cut end pieces of the tie. The kicker apparatus, which includes a pair of kickers that can be extended outwardly, is activated to kick-out both outer end pieces from under their associated rail. Thus, all three pieces of the tie are removed by such a process, and the Tie Shear Machine may move on to the next tie to be removed, where the process is repeated.

Among the drawbacks of a machine such as the Fairmont Tie Shear Machine is that the entire machine must be accurately positioned twice for the removal of a single tie (i.e., once for the cutting and removal of the center piece of tie, and a second time for the removal of the two outer end pieces of tie). Such double movement for each tie is a waste of both the energy used to power the machine and the time of the operator and crew.

SUMMARY

In certain embodiments, a railroad tie removal machine is provided for removing a railroad tie from beneath a pair of spaced rails of a railroad track. The present tie removal machine includes a frame that is movable relative to the railroad track and a tie shear workhead mounted to the frame. The tie shear workhead includes a first pair of shears configured and arranged to cut the tie being removed at a first cut location and a second pair of shears configured and arranged to cut the tie being removed at a second cut location, wherein the second cut location is different from the first cut location.

Further, the first and second cut locations are both located within an area defined between the pair of spaced rails, whereby the first and second cut locations divide the tie into a center portion and two outer portions. Also included is a tie shear raising/lowering mechanism for raising and lowering the first and second pairs of shears with respect to the frame. The tie shear workhead is configured and arranged such that, after the first and second pairs of shears have cut the tie at the first and second cut locations, the first and second pairs of shears remove the center portion of the tie from between the two outer portions of the tie.

The present railroad tie removal machine optionally includes a kicker workhead mounted to the frame, wherein the kicker workhead includes at least one and preferably a pair of kickers configured and arranged to outwardly kick the two outer portions of the cut tie from under the associated rail, and a kicker raising/lowering mechanism for raising and lowering the kickers with respect to the frame. The kicker raising/lowering mechanism moves the kickers along a kicker axis, and the tie shear raising/lowering mechanism moves the first and second pairs of shears along a tie shear axis. To enable sequential operation of the tie shear workhead and the kicker workhead upon the same work area without moving the frame with respect to the railroad track, the tie shear axis is oblique with respect to the kicker axis.

A railroad tie removal machine is provided for removing a railroad tie from beneath a pair of spaced rails of a railroad track in which the tie removal machine includes a frame that is movable relative to the railroad track, wherein when the frame is in a stationary location, a workspace is defined with respect to the stationary frame. A tie shear workhead is mounted to the frame, wherein the tie shear workhead includes a first pair of shears configured and arranged to cut the tie being removed from the workspace at a first cut location and a second pair of shears configured and arranged to cut the tie being removed from the same workspace at a second cut location, wherein the second cut location is different from the first cut location, and further wherein the first and second cut locations are both located within an area defined between the pair of spaced rails. The first and second cut locations divide the tie into a center portion and two outer portions. Also included is a tie shear raising/lowering mechanism for raising and lowering the first and second pairs of shears with respect to the frame. The tie shear raising/lowering mechanism moves the first and second pairs of shears along a tie shear axis. Preferably a kicker workhead is also mounted to the frame. The kicker workhead includes at least one kicker configured and arranged to outwardly kick a corresponding outer portion of the cut tie from under the associated rail, and a kicker raising/lowering mechanism for raising and lowering the kickers with respect to the frame. The kicker raising/lowering mechanism moves the at least one kicker along a kicker axis that is oblique with respect to the tie shear axis.

Also described is a method for removing a railroad tie from beneath a pair of spaced rails of a railroad track using a tie removal machine, wherein the tie removal machine includes a tie shear workhead and a kicker workhead. The method involves positioning the railroad tie removal machine on the railroad track such that the tie shear workhead is aligned above the tie to be removed, and then activating the tie shear workhead to cut the tie being removed. After completing the step of activating the tie shear workhead, but without repositioning the tie removal machine with respect to the railroad track, the method involves performing a step of activating the kicker workhead to kick out the tie being removed, which has now been cut, from below the rails.

DETAILED DESCRIPTION

Figure 1:
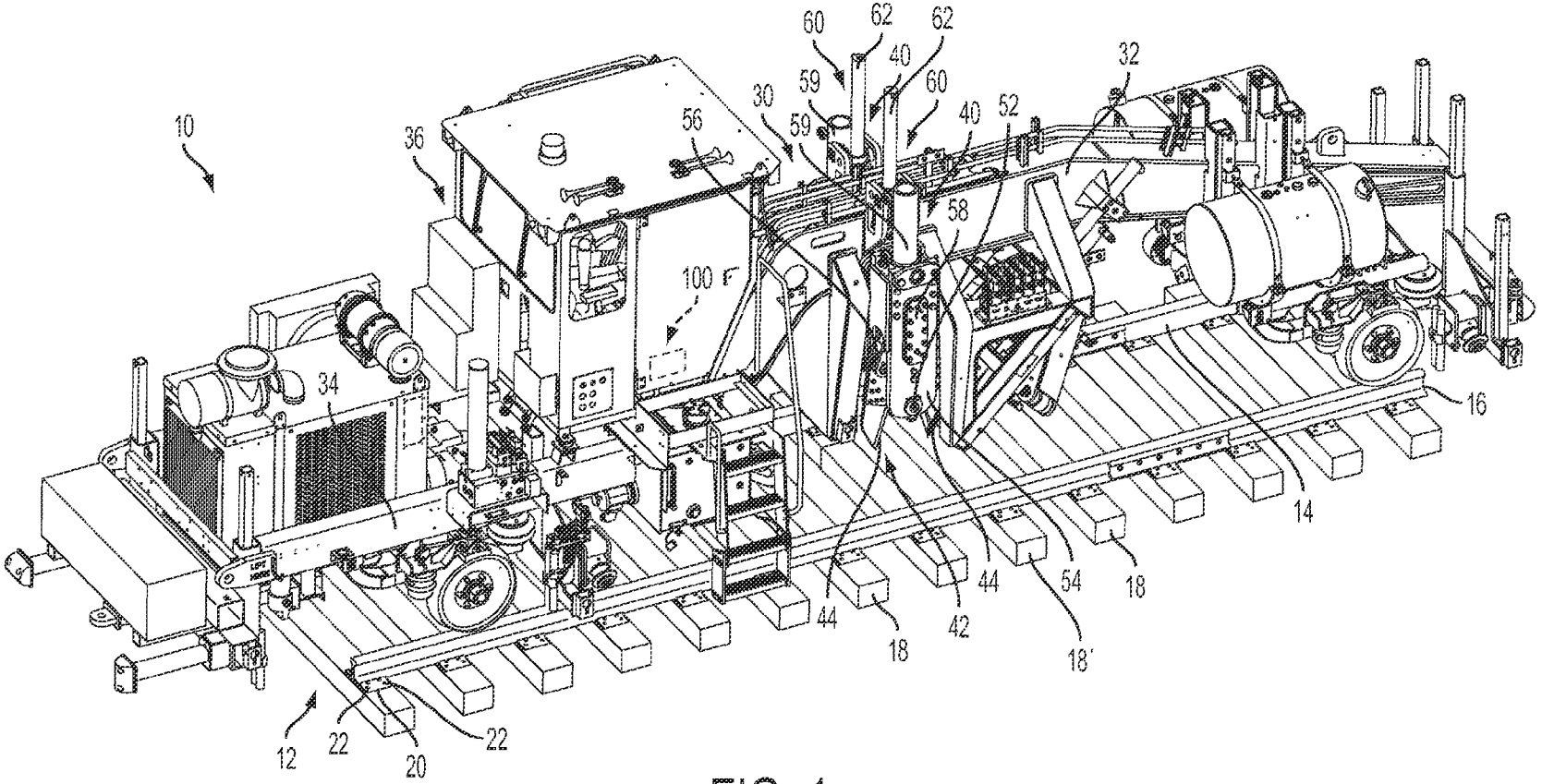
FIG. 1 is a top perspective view of an embodiment of the present railroad tie removal machine, shown in travel mode with all workheads in a rest (retracted) position.

Referring now to FIG. 1, one example of an embodiment of a tie removal machine including the main features of the present invention is generally designated with reference number 10, and it is configured for movement along a railroad track 12. Although the tie removal machine 10 is preferably self-propelled, other means of movement (such as by being towed or pushed) are also contemplated. As is well known in the art, the track 12 includes first and second parallel rails 14, 16, which are connected to ties 18, using tie plates 20 and spikes 22. Ties 18 are typically made of wood.

As described in detail below, the railroad tie removal machine 10 is configured for removing a railroad tie 18 from beneath a pair of spaced rails 14, 16 of a railroad track 12. The tie removal machine 10 includes a frame 30 that is movable relative to the railroad track 12. In this embodiment, the frame 30 includes a major frame 32, upon which one or more workheads are mounted, and a minor frame 34, upon which an operator control station 36 is mounted. Of course other mounting configurations are also contemplated. Associated with the operator control station 36 is a control unit 100 (shown schematically in dashed lines), such as a computer processor, that has been programmed to provide operating instructions to the various workheads, such as a tie shear workhead and a kicker workhead, as well as being programmed for providing operating instructions to the apparatus that moves the tie removal machine 10 and for providing any other typical types of instructions known to those of skill in the railroad maintenance art.

Figure 2:
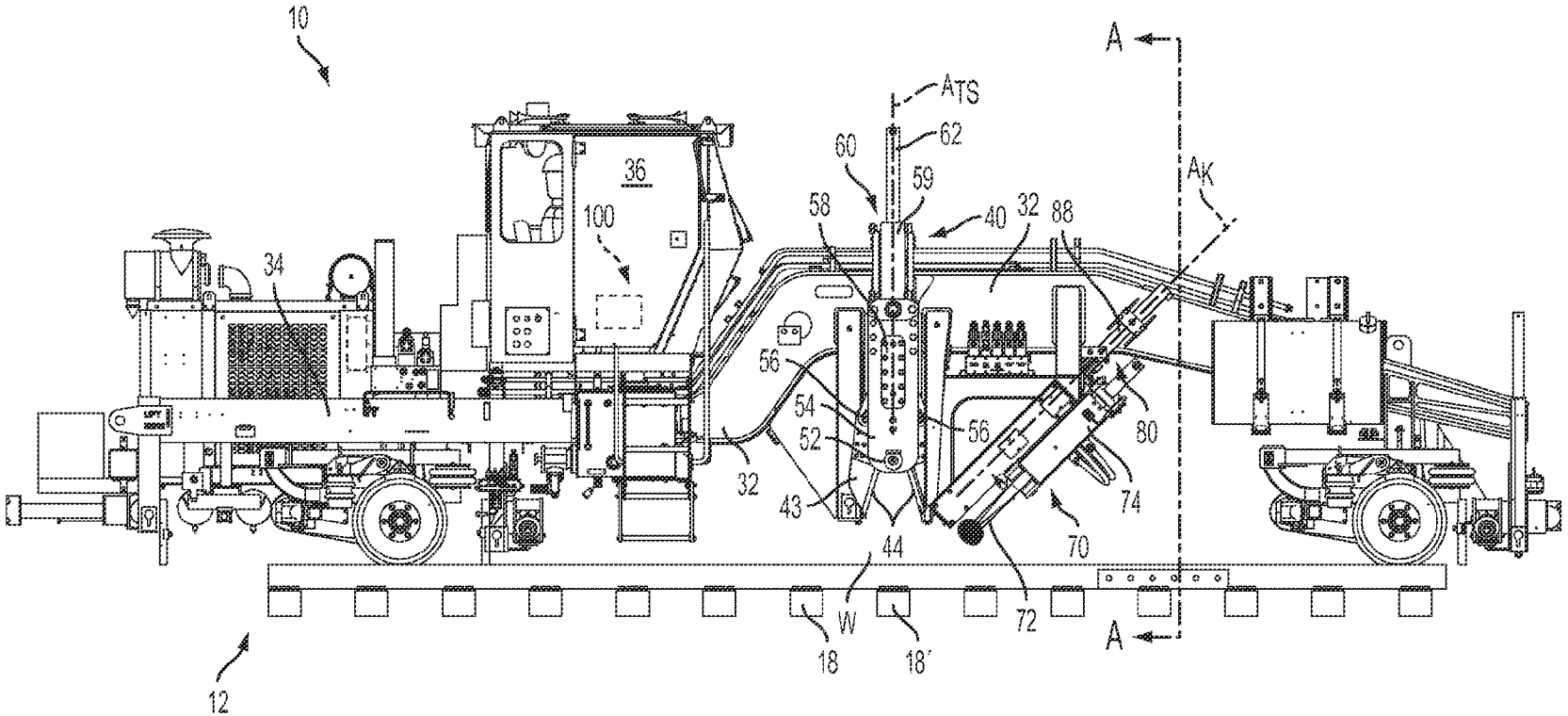
FIG. 2 is a side elevation view of the machine of FIG. 1.

FIGS. 1 and 2 show a tie shear workhead 40 mounted to the frame 30, where in this particular embodiment the workhead 40 is mounted to the major frame 32. The tie shear workhead 40 (as more clearly shown in FIG. 3) includes two pairs of tie cutting shears 42 (only one pair of which can be seen in FIGS. 1 and 2), with one of the pairs of shears being located on one side of the major frame 32 (i.e., between frame 32 and rail 14), and the other of the pairs of shears being located on the opposite side of the major frame 32 (i.e., between frame 32 and rail 16).

Figure 3:
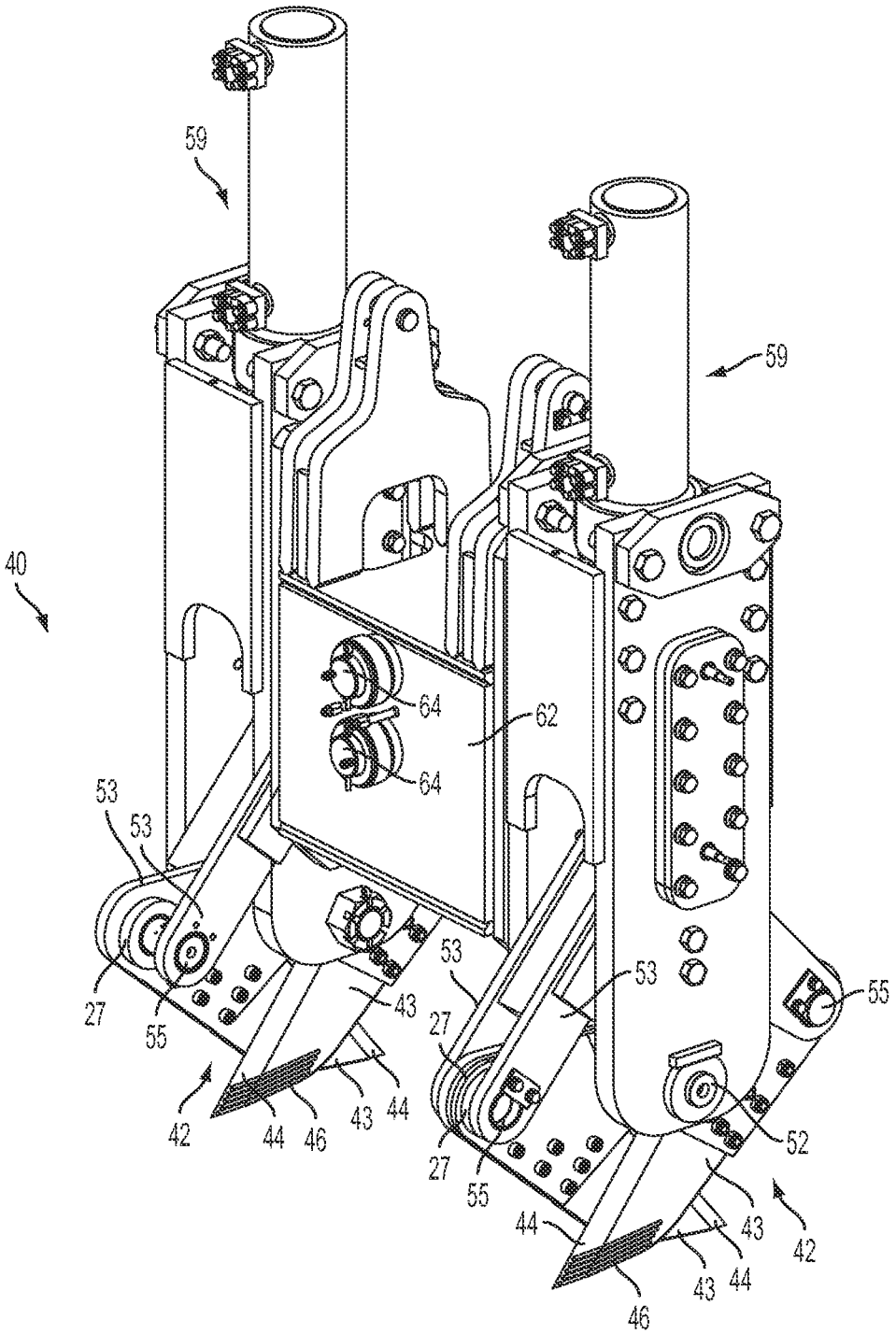
FIG. 3 is a top perspective view of an embodiment of the present shear workhead.
Figure 4:
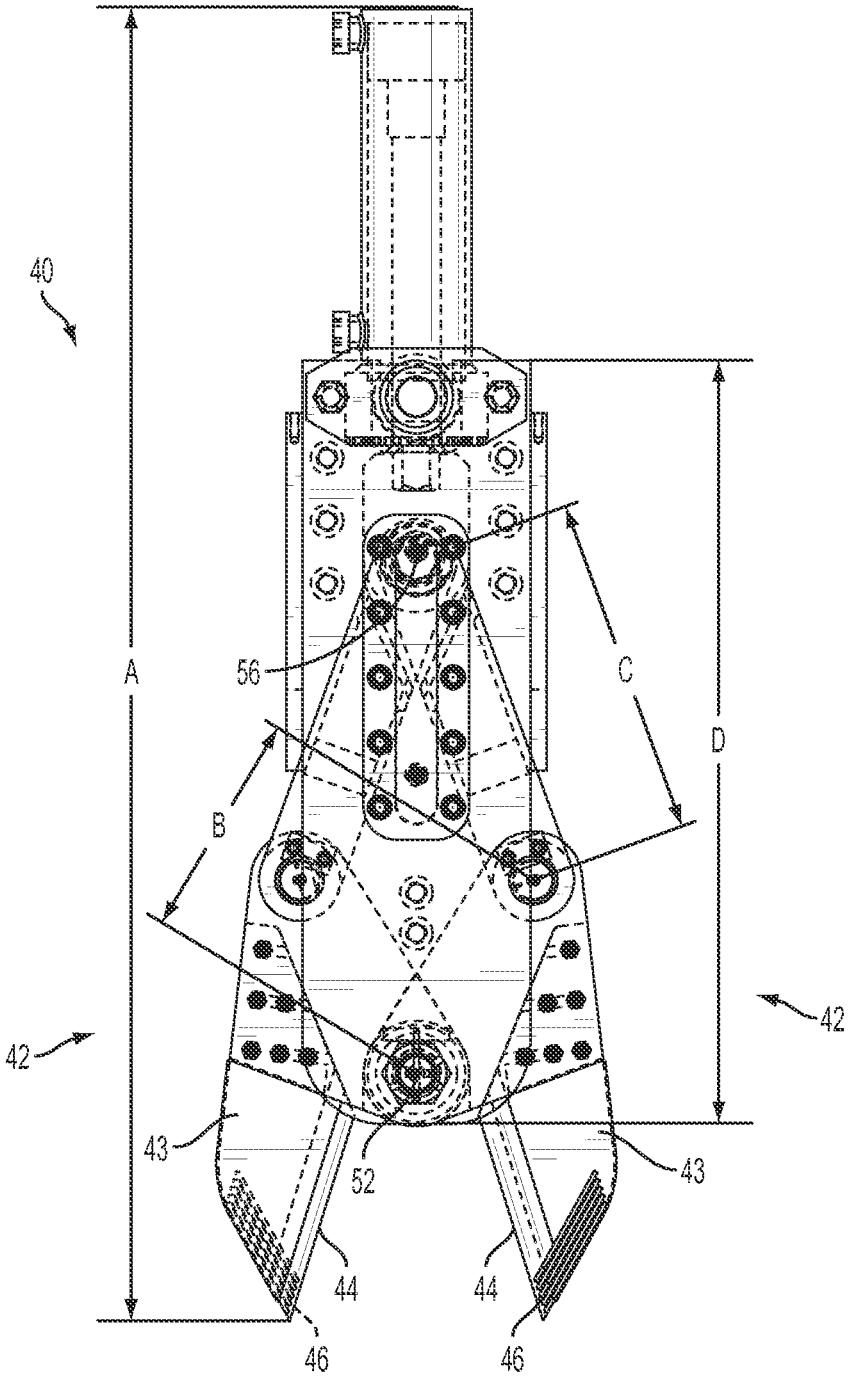
FIG. 4 is a front plan view of a portion of an embodiment of the shear workhead, showing the shears in open position, and including some sample dimensions.

As most easily seen in FIGS. 3 and 4, each set of shears 42 includes two blades 43, each with a sharpened cutting edge 44. In the embodiment shown, the cutting edges 44 are straight edges. However, edges 44 may be arcuate in shape, and may, if desired, be provided with serrations. Optionally, the blades 43 may each include a ribbed portion 46 on the outer side surface thereof, near the lower edge, in order to reduce wear from the ballast. Instead of ribs, another surface finish, such as texturing, may also be used to reduce wear from the ballast at portion 46. The blades 43 of the shears 42 have sufficient strength and sharpness such that a pair of shears cooperates to completely cut through a railroad tie 18 when the shears are closed upon each other with a scissor-like action. Accordingly, the blades 43 of the shears 42 are preferably made of steel or other material of suitable strength and hardness.

Figure 5:
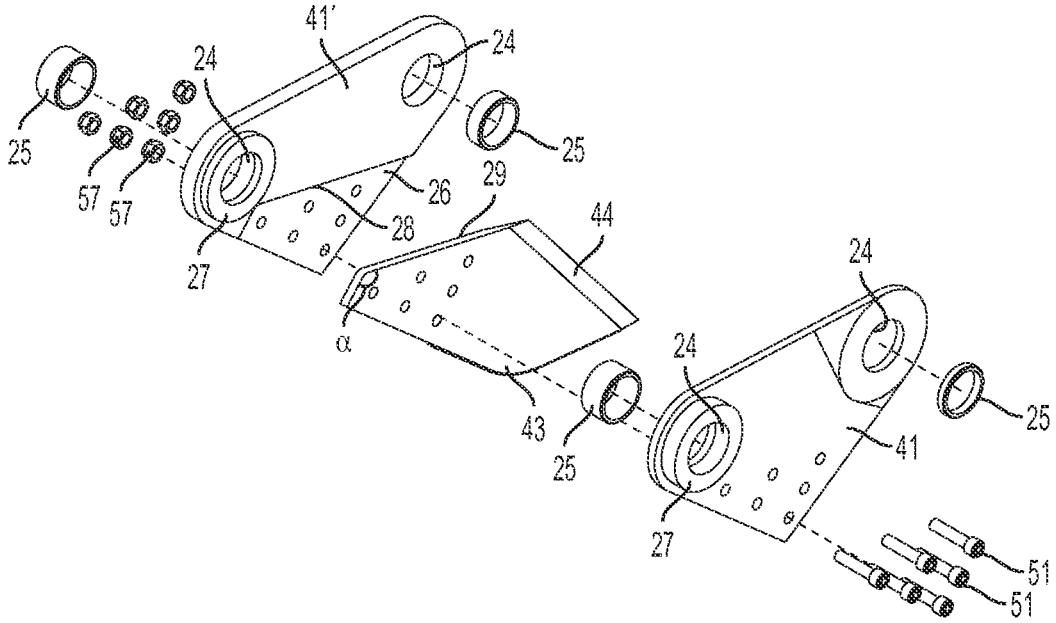
FIG. 5 is an exploded view of the components of the shear blade assembly.

FIG. 5 shows how blade 43 is seated within a blade sub-assembly. In particular, the blade 43 is sandwiched between a pair of blade mounting plates 41, 41'. Each blade mounting plate 41, 41' includes a pair of blade apertures 24 that are each configured to receive a bearing member 25. The bearing members 25 are associated with pivot connections 55, such as shown FIG. 3. In the FIG. 5 embodiment, the blade sub-assembly also includes annular spacers 27, with one spacer between plates 41 and 41', and a second spacer between plate 41 and a linkage arm 53 (FIG. 3).

As can be seen in FIG. 5, the blade mounting plate 41' has a blade recess 26 including an upper surface 28 corresponding in shape to an upper surface 29 of the blade 43. In this embodiment, the corresponding surfaces 28/29 consist of two straight lines (including both a long edge and a short edge) that meet and an angle $\alpha$, which can be any desired angle, but is preferably greater than 90°, such as being within the range of about 100° to about 150°, and more preferably between about 130° and about 140°. The use of such corresponding surfaces 28/29 facilitates alignment of the blade 43 at the proper location between the blade mounting plates 41, 41' until the blade sub-assembly is fixed together via a plurality of bolts 51 and nuts 57. In this embodiment, six bolts 51 are used, and they are arranged in a triangular pattern with a top row of three bolts, a middle row of two bolts and a bottom row of a single bolt, where the rows are parallel to the long edge of the corresponding surfaces 28/29. Such a configuration is useful for stress distribution. It is contemplated that fewer bolts could be used, such as by eliminating the center bolt of the top row and/or eliminating the middle or bottom row entirely. It is also contemplated that additional bolts could be added. Further, it is also contemplated that another bolt pattern could be utilized in place of the triangular pattern, such as a diamond, a square or a rectangular pattern. Finally, although the embodiment shown and described includes a blade recess 26 in only one of the blade mounting plates (plate 41'), it is also contemplated that blade mounting plate 41 could also include such a recess, or that neither blade mounting plate includes such a recess.

As an alternative to (or in addition to) using the blade recess 26 to help position the blade 43 until blade mounting plates 41/41' can be bolted or otherwise affixed together, it is contemplated that either the plate 41 or the plate 41' could include one or more projections that mate with corresponding aperture(s) in the blade 43. For example, such projections could be substituted for one or more of the bolt apertures of the bolt pattern previously described.

To help envision the scale of the tie shearing workhead 40, FIG. 4 includes some sample dimensions for this embodiment. For example, dimension A is preferably between about 70 and about 90 inches, and is 80.2 inches as shown; dimension B is preferably between about 10 and about 16 inches, and is 13.9 inches as shown; dimension C is preferably between about 10 and about 30 inches, and is 21 inches as shown; and dimension D is preferably between about 30 and about 60 inches, and is 47 inches as shown. Of course other dimensions are also contemplated.

Figure 6:
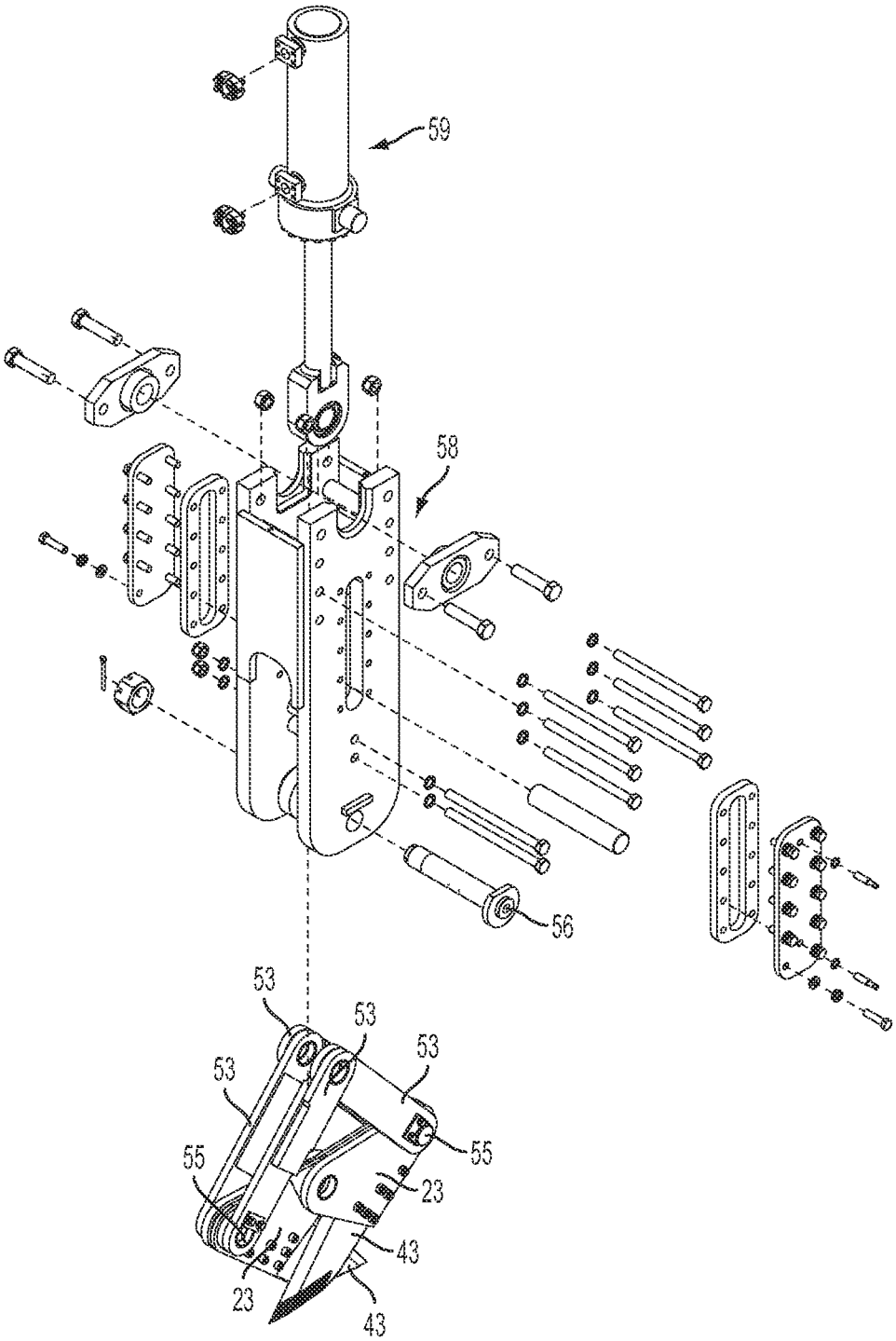
FIG. 6 is an exploded perspective view of the shear workhead of FIG. 3.
Figure 7:
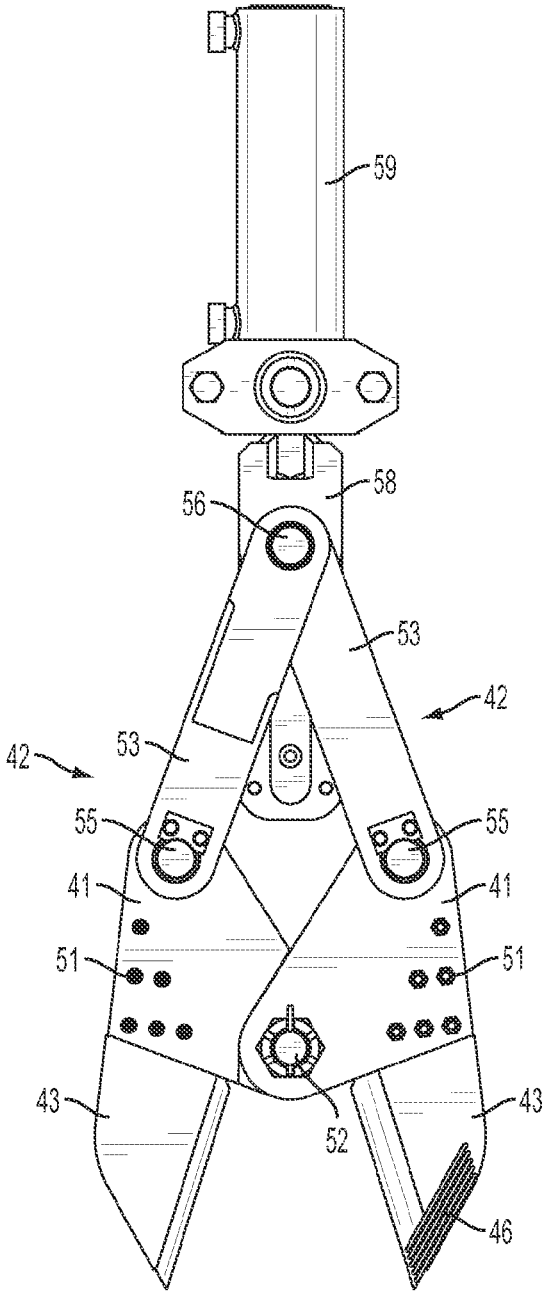
FIG. 7 is a front plan view of an embodiment of the cutting shears and associated components, shown with the shears in open position.
Figure 8:
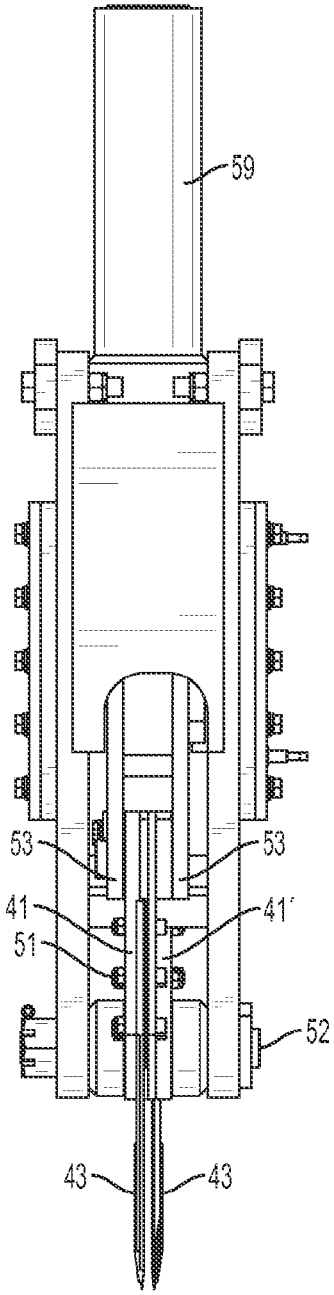
FIG. 8 is a side view of the components of FIG. 7.
Figure 9:
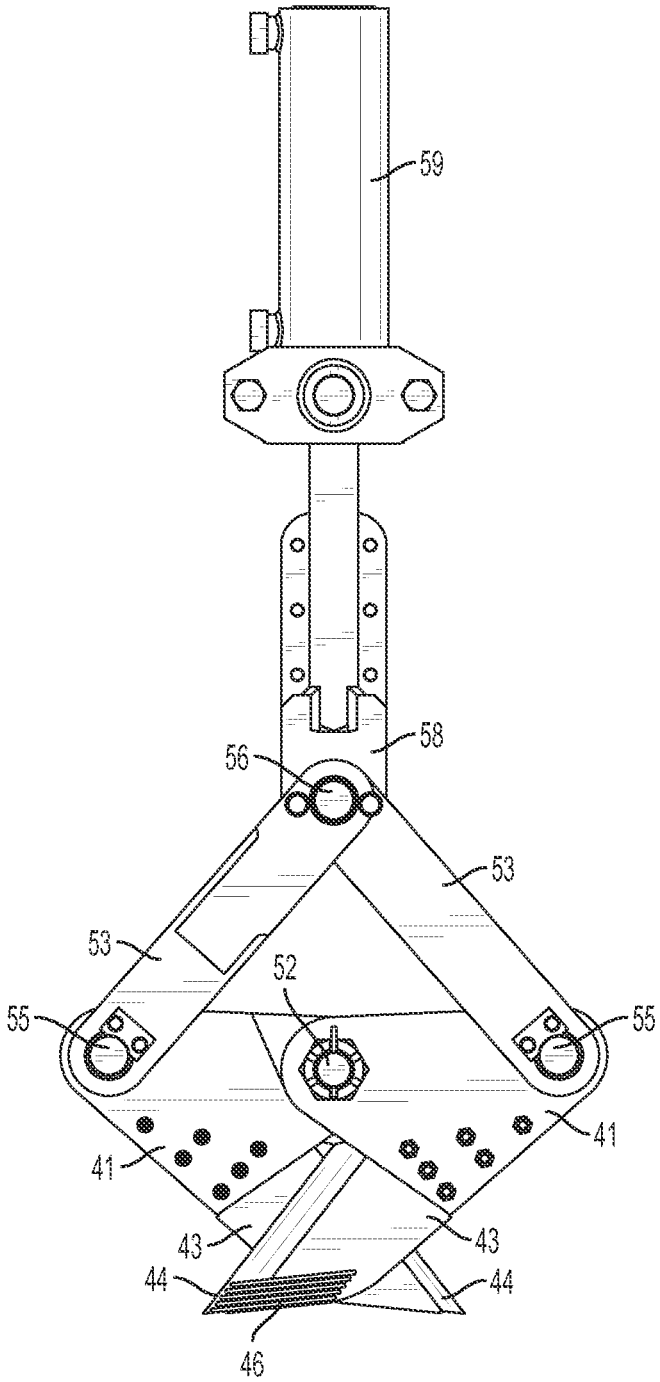
FIG. 9 is a front plan view, similar to FIG. 7, except with the shears in closed position.
Figure 10:
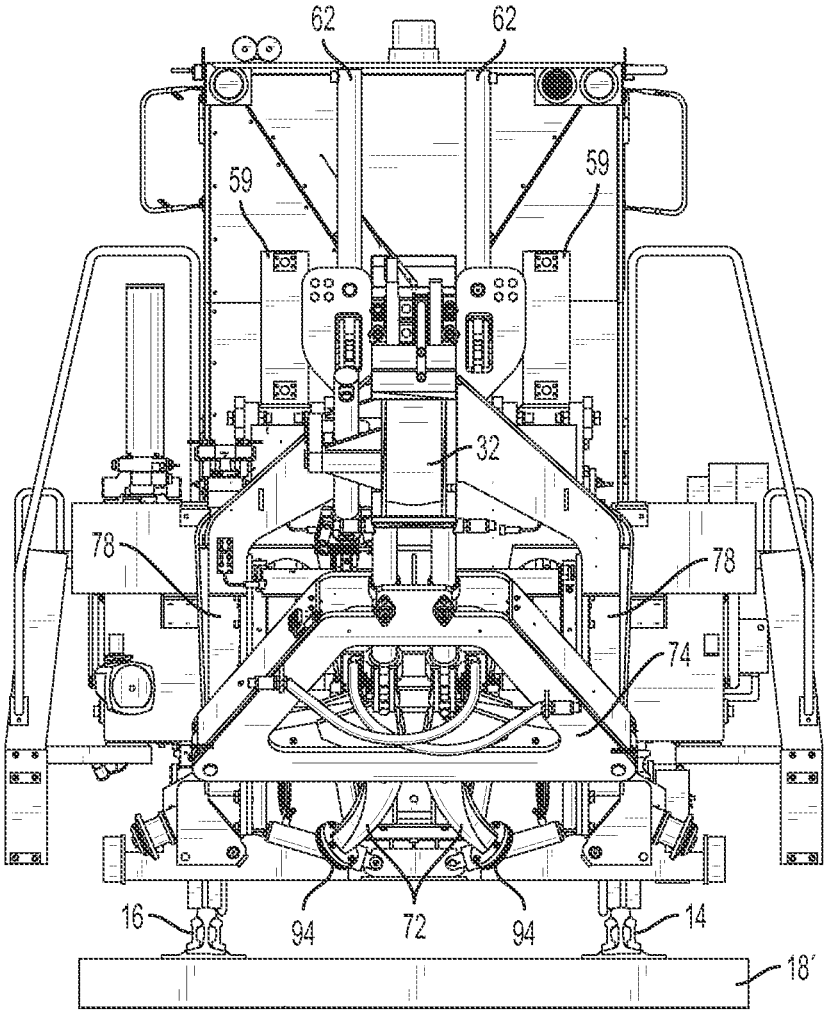
FIG. 10 is a front cross-sectional view of the machine of FIG. 2, taken with respect to line A-A and in the direction generally indicated.

As shown, each blade 43 is sandwiched between the mounting plates 41/41', and the assembly of the plates 41/41' and blade 43 is secured together via the bolts 51. As best seen in FIGS. 7-9, the upper edge of each of the plate/blade assemblies is connected to the lower ends of a pair of linkage arms 53, via a pivot connection 55. Further, the upper ends of all four linkage arms 53 (i.e., two arms 53 per blade 43) are connected to the common yolk 58 via the pivot point 56. As seen in FIG. 6, the common yolk 58 is preferably an assembly of multiple plates that are connected together via a plurality of bolts and nuts, welding or other known fastening devices.

Figure 3A:
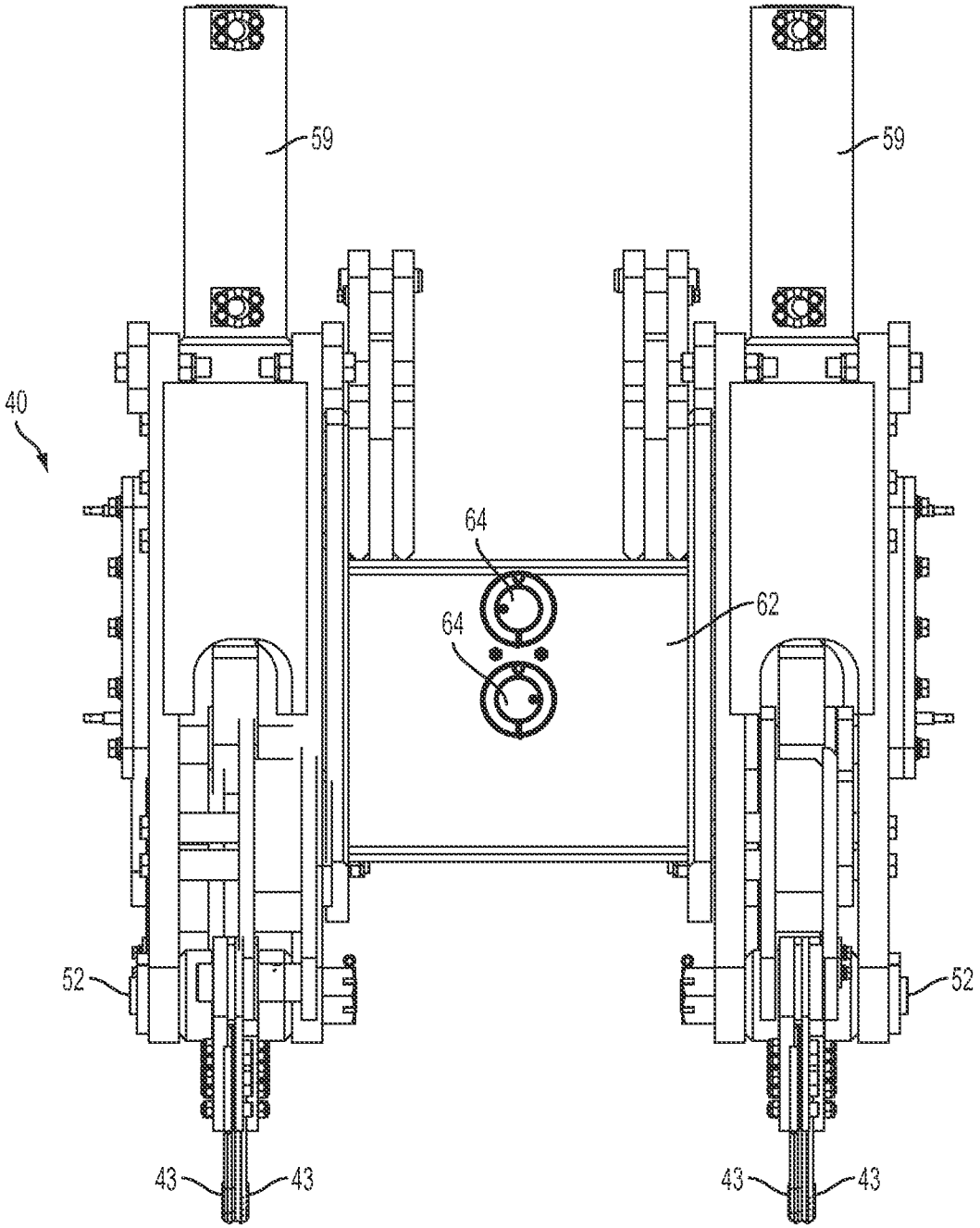
FIG. 3A is a side plan view of the shear workhead of FIG. 3.

As mentioned above, there are two sets of the shears 42, and both sets are preferably operated simultaneously. Of course, it is also contemplated that the shears are optionally operated sequentially, although some of the benefits due to simultaneous operation would be lost. To alleviate twisting encountered by sequential operation of the shears, the shear workhead frame 62 (FIGS. 3 and 3A) includes a pair of rollers 64 that extend through the frame 62, in parallel to the blades 43.

Figure 12:
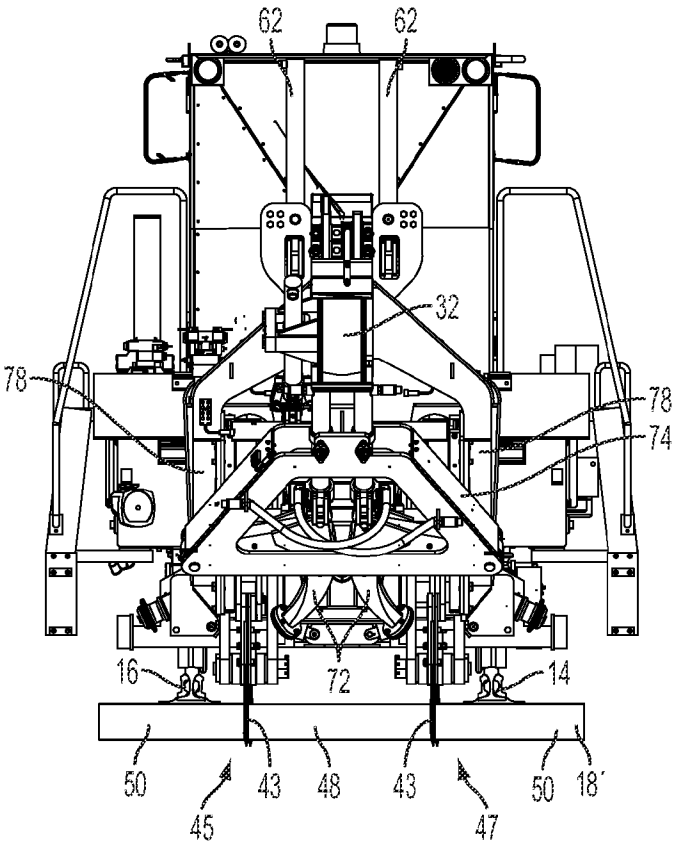
FIG. 12 is a front cross-sectional view of the machine of FIG. 11, taken with respect to line A-A and in the direction generally indicated.

Regardless of whether the shears are operated simultaneously or sequentially, there is a first pair of shears 42 that is configured and arranged to cut the tie being removed (designated as tie 18') at a first cut location 45 (see FIG. 12), as well as a second pair of shears 42 that is configured and arranged to cut the tie 18' at a second cut location 47 (FIG. 12). As seen in FIG. 12, the second cut location 47 is different from the first cut location 45, and the first and second cut locations 45, 47 are both located within an area defined between the pair of spaced rails 14, 16, whereby the first and second cut locations 45, 47 divide the tie 18' into a center portion 48 and two outer portions 50. It should be noted that in FIG. 12 (as well as in the views of FIGS. 14, 16 and 23), the railroad ties 18 in front of the tie being cut (tie 18') have been omitted from the drawing (s) for ease of understanding of the cutting process.

The scissor-like shear action of the shears 42 may be accomplished in any desired manner. Alternatively, the cutting may be performed with another type of cutting action. In FIGS. 1 and 2, both shears 42 are connected together at a pivot point 52 which associates the shears with a tie shear workhead housing 54. For ease of understanding, FIGS. 7-9 show one set of shears 42 with the housing and other components removed. Each shear 42 is connected at an upper pivot point 56 to a common yolk 58. A hydraulic cylinder 59, or other linear force creating apparatus, associated with the housing 54 applies downward force upon the yolk 58, thereby causing the shears 42 to contract in a scissor-like manner, due to the combination of the pivoting actions at the pivot point 52 and the upper pivot point 56. Thus, blades 43 of the shears 42 are moved from the open position of FIG. 7 to the closed position of FIG. 9.

The tie shear workhead 40 also includes a tie shear raising/lowering mechanism 60 (FIGS. 1 and 2) for raising and lowering the first and second pairs of shears 42 with respect to the frame 32. This raising/lowering mechanism 60 includes a pair of hydraulic cylinders 62 (one on each side of the frame 32), where one cylinder 62 moves each tie shear workhead housing 54, and the associated components, with respect to the frame 32 in a vertical direction with respect to the track 12.

As can be seen in FIG. 2, the tie shear raising/lowering mechanism 60 moves the housing 54 and the associated components, such as the first and second pairs of shears 42, along a tie shear axis $A_{TS}$, which is vertical with respect to the track 12. As explained more fully below, the tie shear workhead 40 can be moved between a rest (or retracted) position, such as shown in FIGS. 1 and 2, to a working position, such as shown in FIGS. 11-14. In the rest position, the tie shear workhead 40 is retracted toward the frame 34. Thus, the rest position is also a travel mode because the tie removal machine 10 is configured for travel along the track in this configuration. On the other hand, in the working position (FIGS. 11-14), the tie cutting shears 42 of the tie shear workhead 40 are in position to cut a tie.

Figure 14:
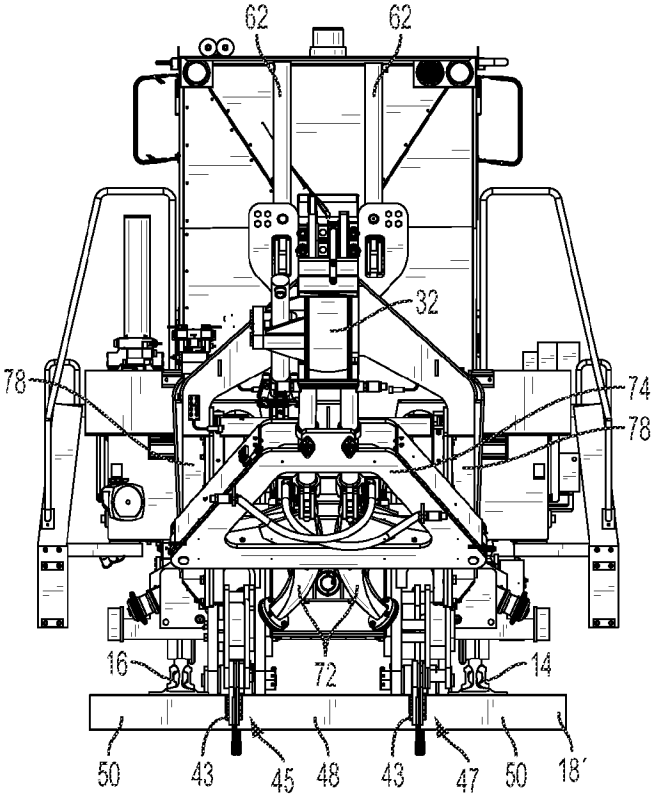
FIG. 14 is a front cross-sectional view of the machine of FIG. 6, taken with respect to line A-A and in the direction generally indicated.
Figure 13:
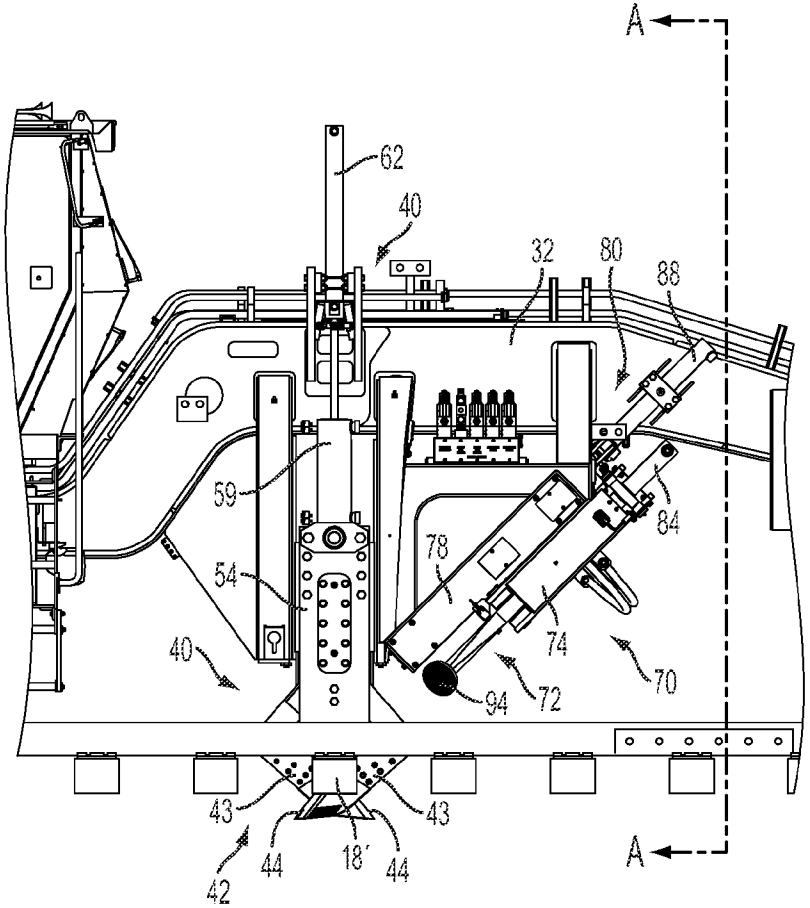
FIG. 13 is a close-up of a portion of the machine of FIG. 1, shown with both pairs of shears of the tie shear workhead closed, thereby cutting the tie into three sections—a center portion and two outer portions.
Figure 16:
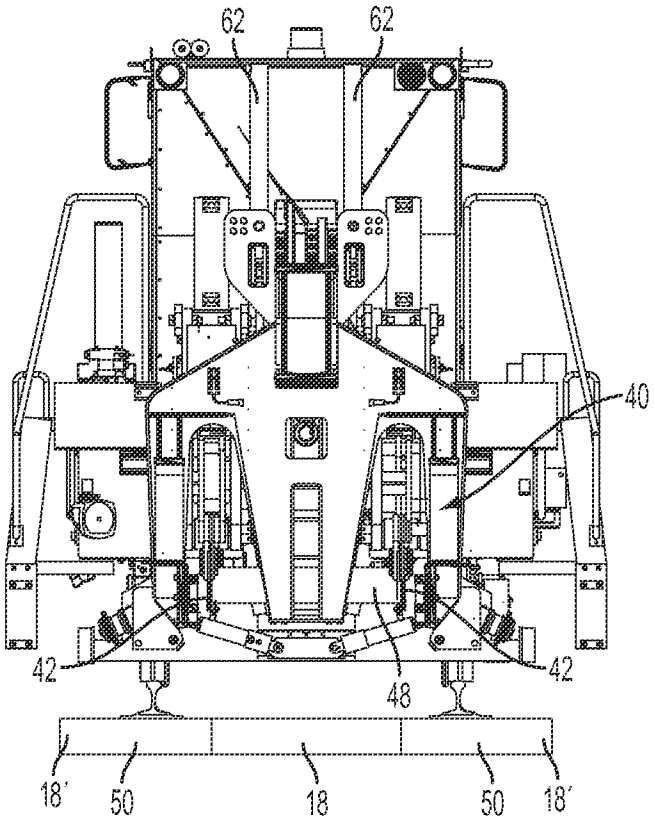
FIG. 16 is a front cross-sectional view of the machine of FIG. 15, taken with respect to line A-A and in the direction generally indicated.
Figure 15:
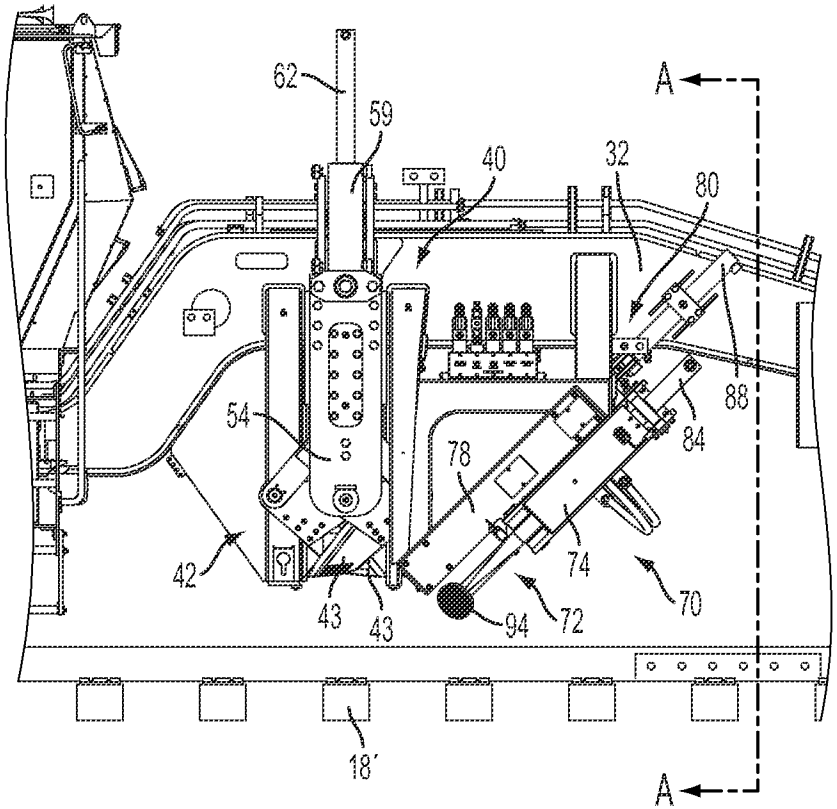
FIG. 15 is a close-up of a portion of the machine of FIG. 1, shown with the tie shear workhead retracted, but with both pairs of shears of the tie shear head still closed, thereby lifting the center portion of the tie from between the two outer portions of the tie.

Another feature of the present tie shear workhead 40 is that it is configured and arranged such that, after the first and second pairs of shears 42 have cut the tie 18' at the first and second cut locations (45, 47 of FIG. 12), the first and second pairs of shears remove the center portion 48 of the tie from between the two outer portions 50 of the tie. More specifically, FIGS. 13 and 14 show how when the two pairs of shears 42 are closed in the scissor-like manner, the center portion 48 of the tie (which has just been cut from the tie 18' by both pairs of shears 42) is trapped between the two pairs of shears 42. As can be seen in FIGS. 15 and 16 (where in FIG. 16, the components in front of the shear workhead 40 have been removed to facilitate understanding), both pairs of shears 42 remain closed while the tie shear workhead 40 is lifted by the cylinder 60 back into the rest position. Such a configuration allows for the cutting and removal of the center portion 48 of the tie using only the tie shear workhead, which avoids the need for an extra workhead designed for only lifting the center portion of the tie. Of course, other embodiments in which the tie shear workhead 40 lacks this center portion removal feature are also contemplated, but such embodiments would need an extra workhead to accomplish this task.

The main embodiment of the present railroad tie removal machine 10 preferably includes a kicker workhead 70 mounted to the frame 32. The kicker workhead 70 includes a pair of kickers 72 (best seen in FIGS. 21-23) that are configured and arranged to outwardly kick the two outer portions 50 of the cut tie 18' from under the associated rail 14 or 16.

Figure 22:
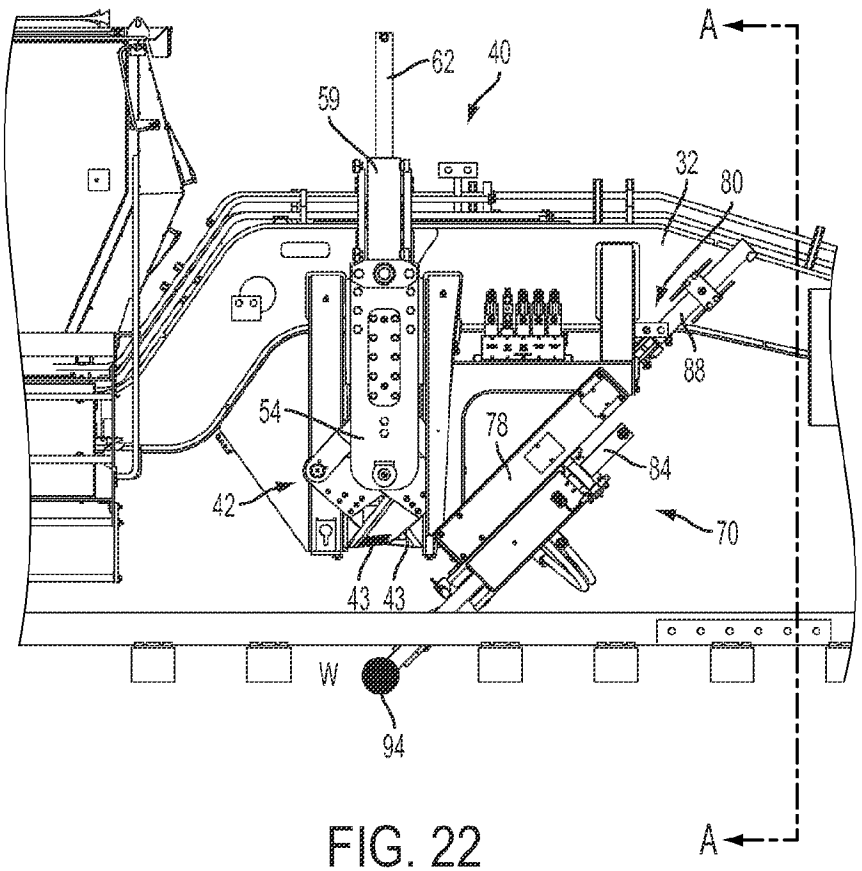
FIG. 22 is a close-up of a portion of the machine of FIG. 1, shown with the pair of kickers extended into an impact position, kicking-out the two outer portions of the cut tie.

As shown in FIG. 22, the kicker workhead 70 also includes a kicker raising/lowering mechanism 80 for raising and lowering the kickers 72 and the associated components with respect to the major frame 32. The kicker raising/lowering mechanism 80 is configured to move the kickers and associated components between a rest or travel position, in which the kicker workhead 70 is retracted, such as shown in FIGS. 2, 4, 6 and 8, and a working position, in which the workhead is extended to be in the workspace, such as shown in FIGS. 10-13. The kicker raising/lowering mechanism 80 is preferably a hydraulic cylinder 88, such as shown in FIGS. 2, 11, 13, 15, 17, and 22, however other equivalent mechanisms are contemplated, as are well known in the art.

Figure 18:
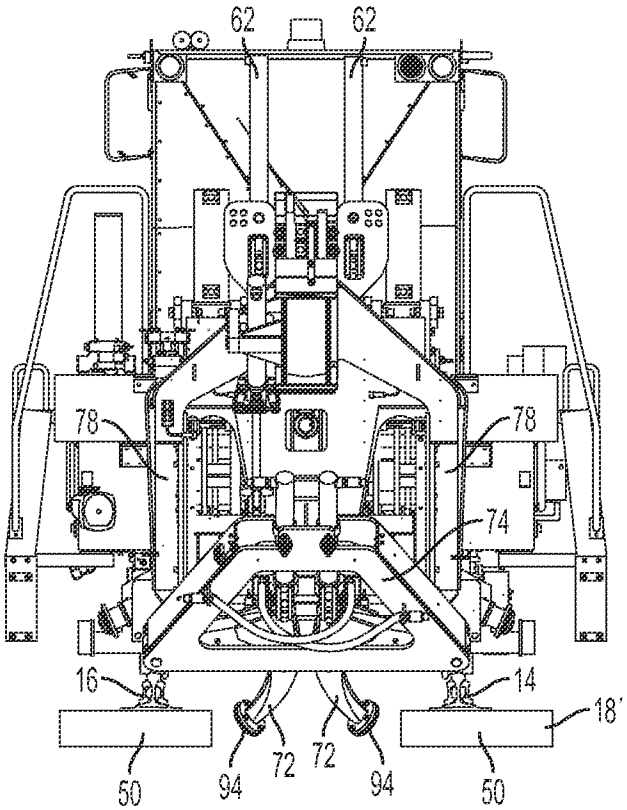
FIG. 18 is a front cross-sectional view of the machine of FIG. 17, taken with respect to line A-A and in the direction generally indicated.
Figure 19:
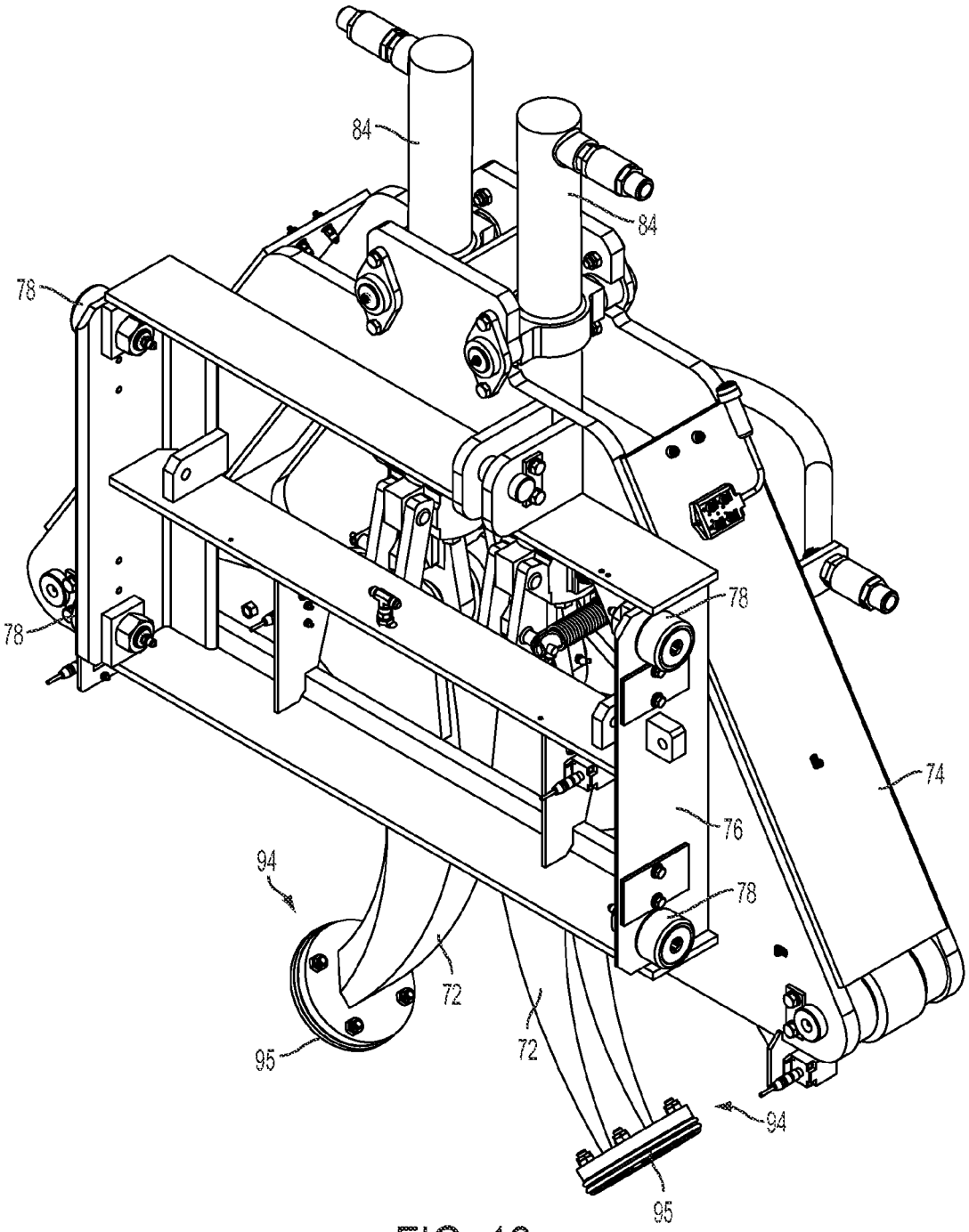
FIG. 19 is a front perspective view of a portion of an embodiment of the kicker workhead.
Figure 20:
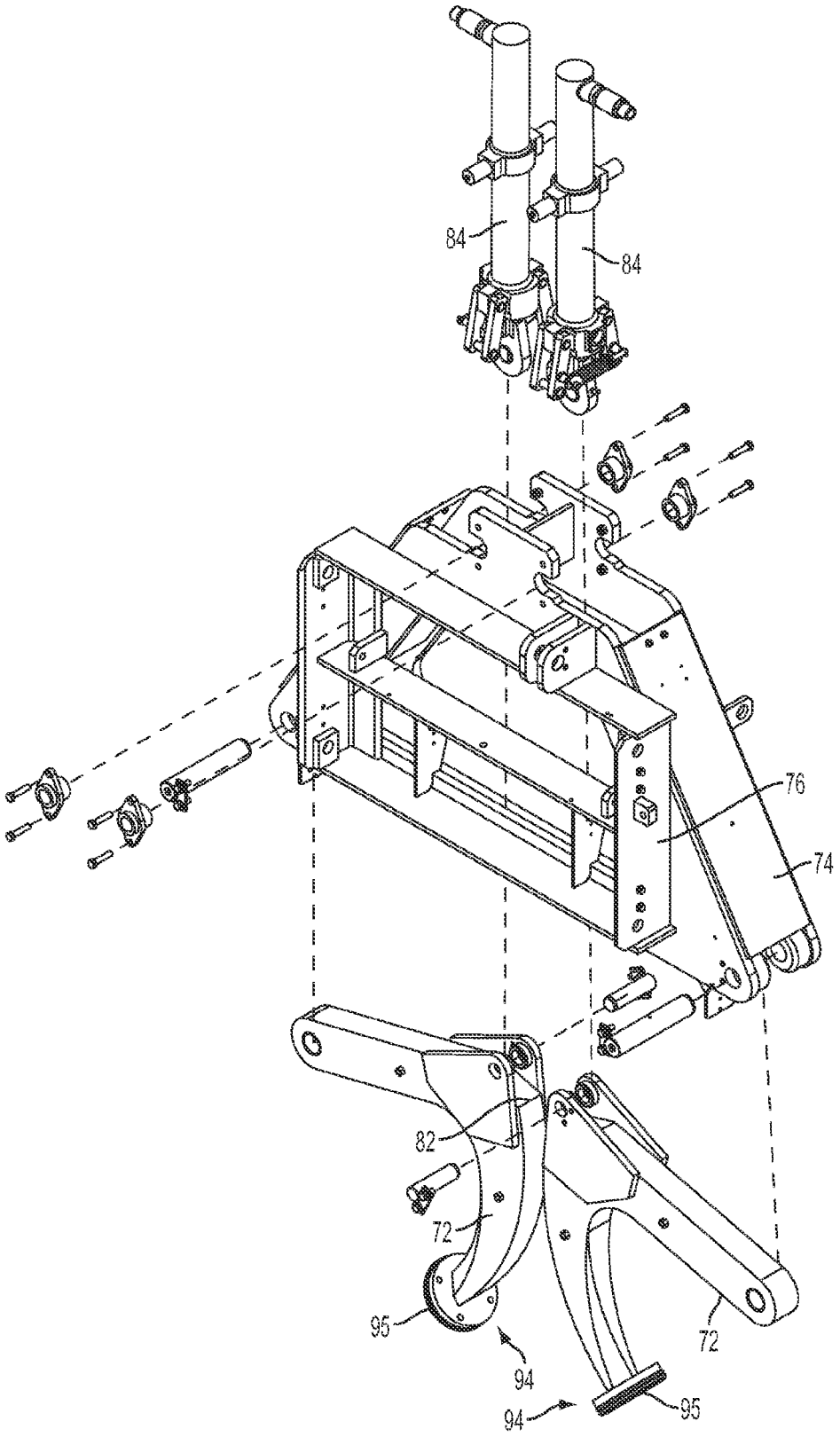
FIG. 20 is an exploded perspective view of the components of FIG. 19.
Figure 21:
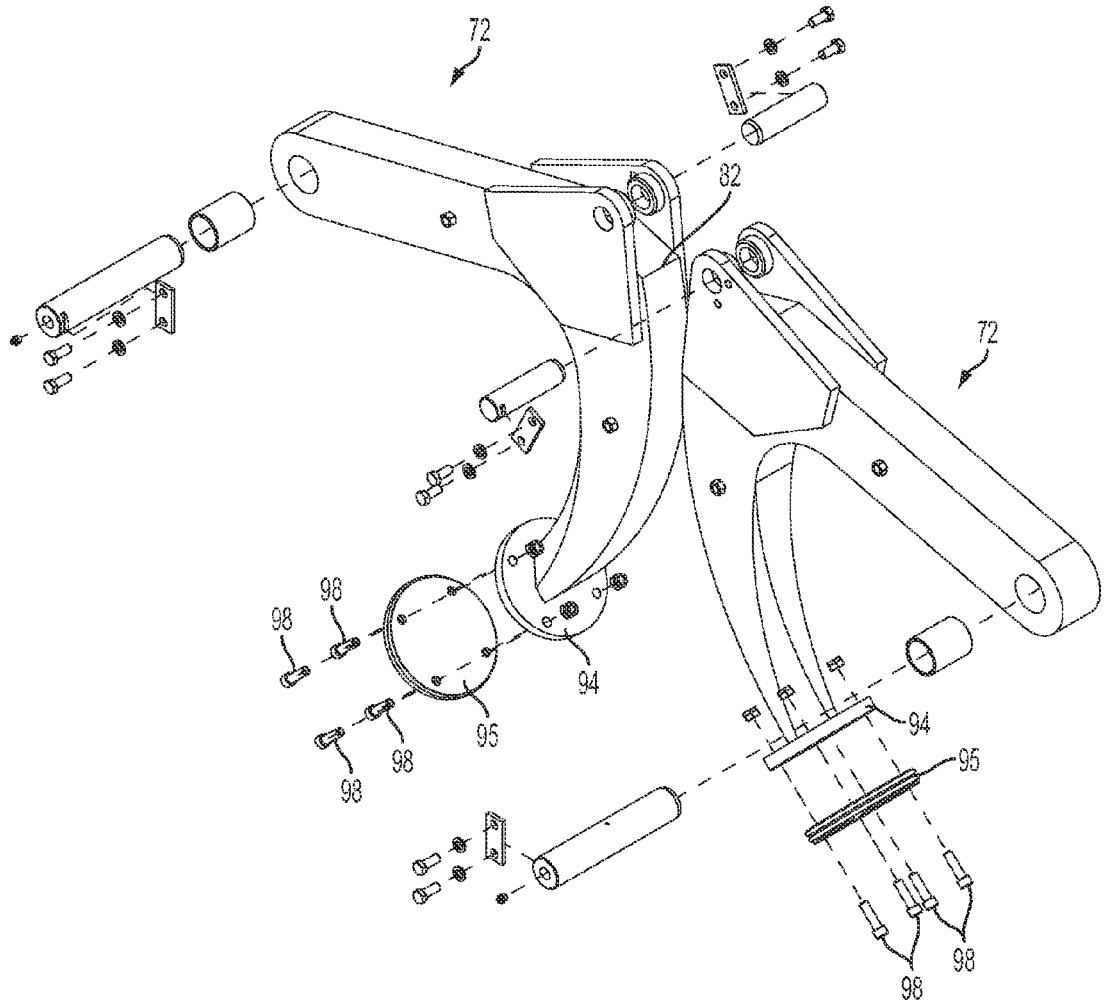
FIG. 21 is an exploded perspective view of an embodiment of the kickers.

Some details of the components of the kicker workhead 70 will now be provided while referring to FIGS. 19-21. FIG. 19 shows a kicker frame 74 that is attached to a kicker carriage 76 in an assembled configuration, and FIG. 20 shows these components in an exploded view. In this embodiment, the kicker frame 74 is a generally open trapezoidal frame (see FIGS. 10, 12, 14, 18, and 22). The kicker frame 74 is rigidly connected to the kicker carriage 76 by any suitable attachment members. Included on the kicker carriage 76 is a plurality of rollers 78 so that the assembly of the kicker frame 74 and kicker carriage 76 can be moved linearly within a pair of kicker track members 78 (FIGS. 10, 12, 14, and 18) by the cylinder 88.

Figure 23:
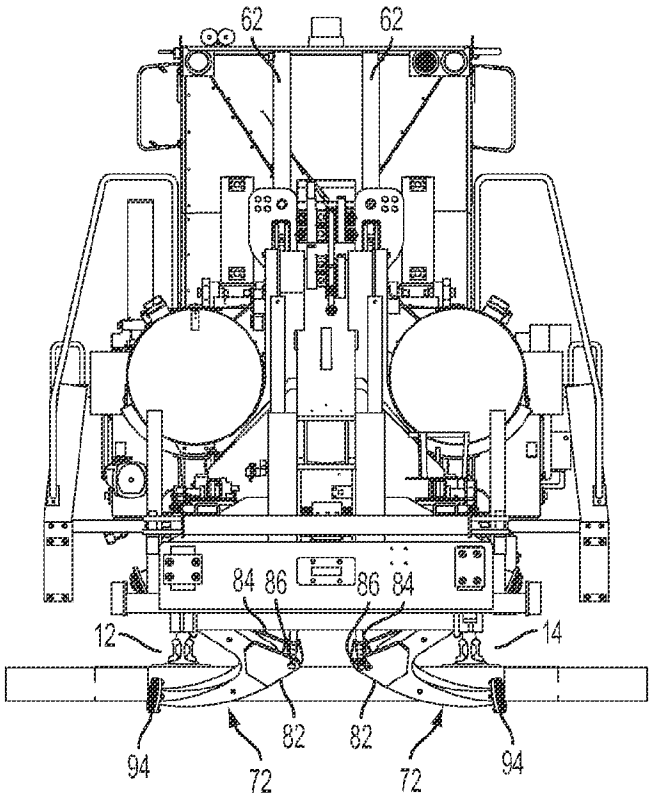
FIG. 23 is a front cross-sectional view of the machine of FIG. 22, taken with respect to line A-A and in the direction generally indicated.

As best seen in FIGS. 21 and 23, in this embodiment, each of the kickers 72 consists of a generally V-shaped member (with the "V" turned sideways and opening towards the rail), whereby the V-shaped members are oriented so that the apex 82 of one V-shaped member faces the apex 82 of the other V-shaped member. In other words, the open ends of the V's of the two V-shaped members face sideways and away from each other. As can be seen in FIGS. 19-21, each of the V-shaped members 72 includes a kicker head 94 on the lower portion thereof. To extend the life of the each V-shaped member 72, each kicker head 94 preferably includes a wear member 95 attached thereto. Thus, the wear member 95 will protect the kicker head 94 from wearing during normal operation, and the wear member 95 can be replaced when necessary, instead of replacing the entire V-shaped member 72.

In the embodiment shown in FIGS. 19-21, the wear member 95 is affixed to the kicker head 94 at four positions, such as by bolts 98. Preferably, the locations of the affixing members are symmetric about both a horizontal axis and a vertical axis, thereby enabling the wear member 95 to be attached to the kicker head 94 in any one of a plurality of positions so that the wear member can be removed and re-attached to the kicker head at a different position as the wear member wears. More specifically, the lower portion of the wear member 95 will most likely be subject to the most wear, while the upper portion will be subject to the least wear. Accordingly, with the configuration shown in the drawings, when the lower portion of the wear member 95 has been damaged due to wear, the wear member may be removed from the kicker head 94 and rotated a quarter turn (90°), and then re-attached to the kicker head. Such a process may be performed four times so that all outer edges of the wear member have been damaged due to wear, at which point a new wear member is attached.

The kicker workhead 70 also includes a cylinder 84, such as a hydraulic cylinder, for moving each of the generally V-shaped members. One cylinder 84 is pivotably attached to each of the generally V-shaped members at a pivot point 86 at the apex 82.

As can be seen in FIGS. 17, 18, 22 and 23, the two cylinders 84 are configured and arranged to move the generally V-shaped members 72 between a ready position (FIGS. 17 and 18), in which heads 94 of the kickers 72 are out of contact with the two outer portions 50 of the cut tie, and an impact position, in which the heads make contact with an end of each of the two outer portions of the cut tie. FIGS. 22 and 23 show the kickers 72 immediately after the impact position, after contact has been made and the outer portions 50 have been kicked out.

Although hydraulic cylinders are shown and described, it is also contemplated that other types of cylinders could be used instead, or that even other types of force creating/transmitting mechanisms could be utilized in place of the hydraulic cylinders.

Another feature of the present tie removal machine 10 is that the tie shear workhead 40 and the kicker workhead 70 can be used to sequentially perform their designated functions in the same workspace "W" (FIGS. 2, 22), such as on the same tie that is intended to be removed, without requiring that the tie removal machine 10 be moved with respect to the railroad track 12. This benefit is accomplished by providing for the tie shear workhead 40 to be raised and lowered along one axis, and by providing for the kicker workhead 70 to be raised and lowered along another axis that is oblique with respect to the tie shear workhead axis.

More specifically, as can be seen in FIG. 2, the tie shear raising/lowering mechanism 60 moves the tie shear workhead 40 and the associated components, such as the first and second pairs of shears 42, along a tie shear axis $A_{TS}$. In contrast, as can also be seen in FIG. 2, the kicker raising/lowering mechanism 80 moves the kicker worked 70 and the associated components, such as the kickers 72, along a kicker axis $A_K$. As can be seen in FIG. 2, the tie shear axis $A_{TS}$ is oblique with respect to the kicker axis $A_K$. In the embodiment shown and described, the tie shear axis $A_{TS}$ is generally vertical with respect the rails 14, 16 of the railroad track 12 when the railroad tie removal machine 10 is positioned upon the railroad track, and the kicker axis $A_K$ is angled, such as at a 45 degree angle, with respect to the rails and to the tie shear axis $A_{TS}$. However, it is also contemplated that the positions of the two workheads could be reversed (i.e., the kicker axis $A_K$ could be vertical and the tie shear axis $A_{TS}$ could be angled, such as at a 45 degree angle, with respect to the rails). Of course, other angles between the kicker axis $A_K$ and the tie shear axis $A_{TS}$ besides a 45 degree angle could also be utilized (such as any desired angle between 30 and 60 degrees). Further, it is also contemplated that neither axis be vertical, and that both axes be oblique with respect to the rails.

In operation, an embodiment of the present tie removal machine 10, including a tie shear workhead 40 and a kicker workhead 70, can be used in a method for removing a railroad tie (such as tie 18') from beneath a pair of spaced rails 14, 16 of a railroad track 12. The tie removal machine 10 is operated after one or more other machines have been operated to remove the tie plates, the spikes and the ballast from the relevant area. The present method involves, as shown in FIG. 2, positioning the railroad tie removal machine 10 on the railroad track 12 such that the tie shear workhead 40 is aligned above the tie 18' to be removed. As can be seen in FIG. 2, the tie shear workhead 40 is in a rest (or travel) position, as indicated by the workhead being in its uppermost (retracted) position with the shears 42 open.

Figure 11:
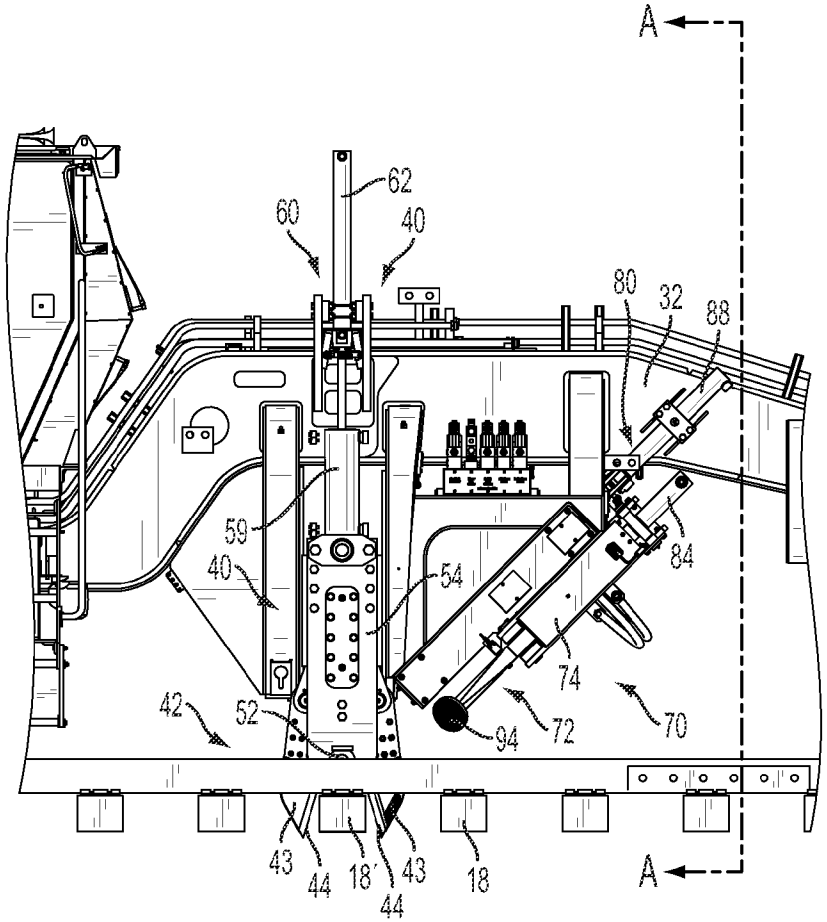
FIG. 11 is a close-up of a portion of the machine of FIG. 1, shown with the tie shear workhead lowered into a working position.

The next step involves lowering the tie shear workhead 40 from the rest position of FIG. 2) to the working position of FIGS. 11 and 12. After the workhead 40 has been lowered, it is activated to cut the tie 18' intended to be removed. Such activation involves simultaneously closing both pairs of shears 42 upon the tie, thereby shear the tie 18' at both the first cut location 45 and the second cut location 47, as shown in FIGS. 13 and 14. Such a procedure results in a tie that has been divided into the center portion 48 and two outer portions 50.

Next, after the step of activating the tie shear workhead, a step of raising the tie shear workhead 40 back to the rest position is performed. FIG. 15 shows the tie shear workhead 40 back at the rest position. However, this time, when the workhead 40 is lifted, both pairs of shears 42 remain closed, as can be seen in FIG. 15. Keeping the shears 42 closed enables the two pairs of shears to cooperate to lift and remove the cut center portion 48 of the tie (FIG. 14), which is wedged between the two pairs of shears. FIG. 9 shows how only the two outer portions 50 of the tie remain at this point, because the center portion has been lifted by the shears of the tie shear workhead 40.

After completing the step of activating the tie shear workhead 40, but without re-positioning the tie removal machine 10 with respect to the railroad track 12, the kick-out steps represented in FIGS. 17, 18, 22 and 23 are performed. Such kick-out steps involve activating the kicker workhead 70 to kick out the outer portions 50 of the tie being removed from below the rails.

Figure 17:
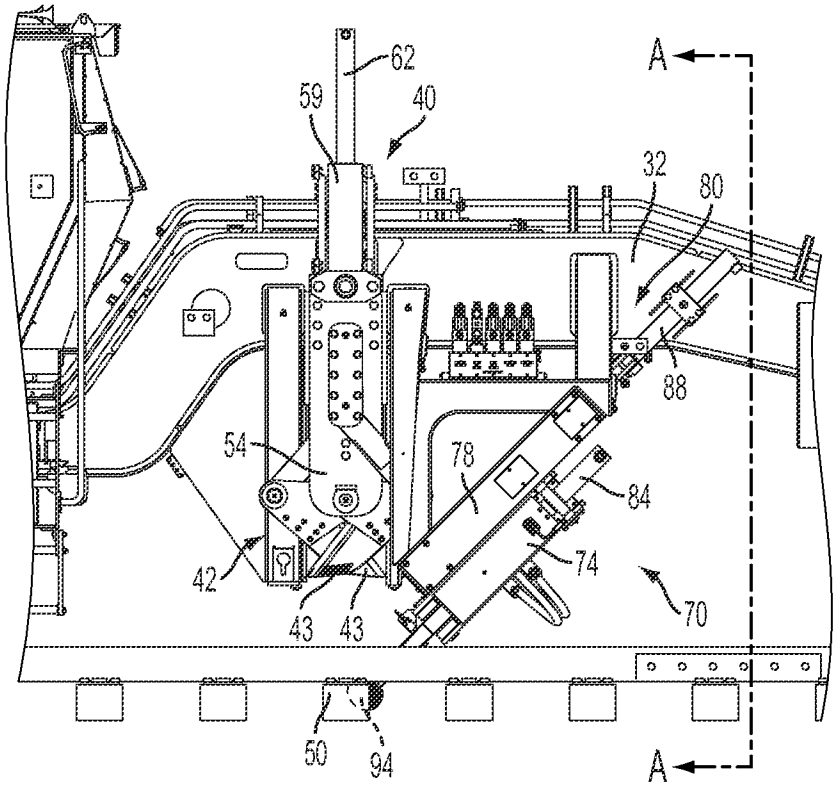
FIG. 17 is a close-up of a portion of the machine of FIG. 1, shown with the kicker workhead lowered into a working (or ready) position, ready to be activated to kick-out the two outer portions of the cut tie.

More specifically, such activation involves first lowering the kicker workhead 70 from a rest position (such as shown in FIG. 16) to a working position (such as shown in FIG. 17). As shown in FIG. 11, the kickers 72 will now be in a ready position, whereby the kicker heads 94 are not in contact with the two outer tie portions 50. Next, the two kickers 72 are forced outwardly to thereby outwardly kick the two outer portions 50 of the cut tie from under the associated rails 12 and 14. The result of such a step is shown in FIGS. 22 and 23, which show that the two outer portions 50 of the tie are gone.

Finally, now that the entire tie has been removed, the kickers 72 can be moved back inwardly to the ready position, and the kicker workhead 40 can be lifted to the rest position. If additional ties are to be removed, the entire tie removal machine 10 can be moved to the next tie intended for removal, and the process can be repeated. Such process is repeated until all ties intended for removal have been removed. Afterwards, in locations where the ties have been removed, new ties can be installed using any desired method and machinery.

Preferably, the process steps mentioned can be automated, or at least semi-automated, by programming the computer processor of the control unit associated with the operator control station 36. For example, generally, the operating instructions of the control unit include instructions to perform the following steps, in order:

(a) lower the first and second pairs of shears 42 into the workspace from the position of FIGS. 1 and 2 to the position of FIGS. 11 and 12;

(b) activate the cutting action to use the first and second pairs of shears 42 to cut the tie within the workspace, such as shown in FIGS. 13 and 14;

(c) raise the first and second pairs of shears 42 out of the workspace to the position shown in FIGS. 15 and 16;

(d) lower the kicker workhead 70 from a rest position (such as in FIG. 15) to a working position (such as in FIGS. 17 and 18);

(e) activate the kickers 72 to outwardly kick the two outer portions 50 of the cut tie that is located within the workspace (see FIGS. 22 and 23);

(f) retract the kickers 72 to a ready position (such as in FIG. 18); and (g) raise the kicker workhead 70 back to the rest position (such as in FIGS. 1 and 2).

For example, the control unit 100 can be programmed such that each of the process steps (a) through (g) requires the operator to initiate each step separately by providing a user input such as activating a designated button or contacting an appropriate location on a touch screen. Alternatively, the control unit 100 could be programmed so that all of the process steps are performed after the user provides a single input, of the control unit could be performed so that certain process steps are combined so that they are performed together after the appropriate user input (such as having a single input for steps (a) through (c) and then having a separate user input for steps (d) through (g)).

Figure 24:
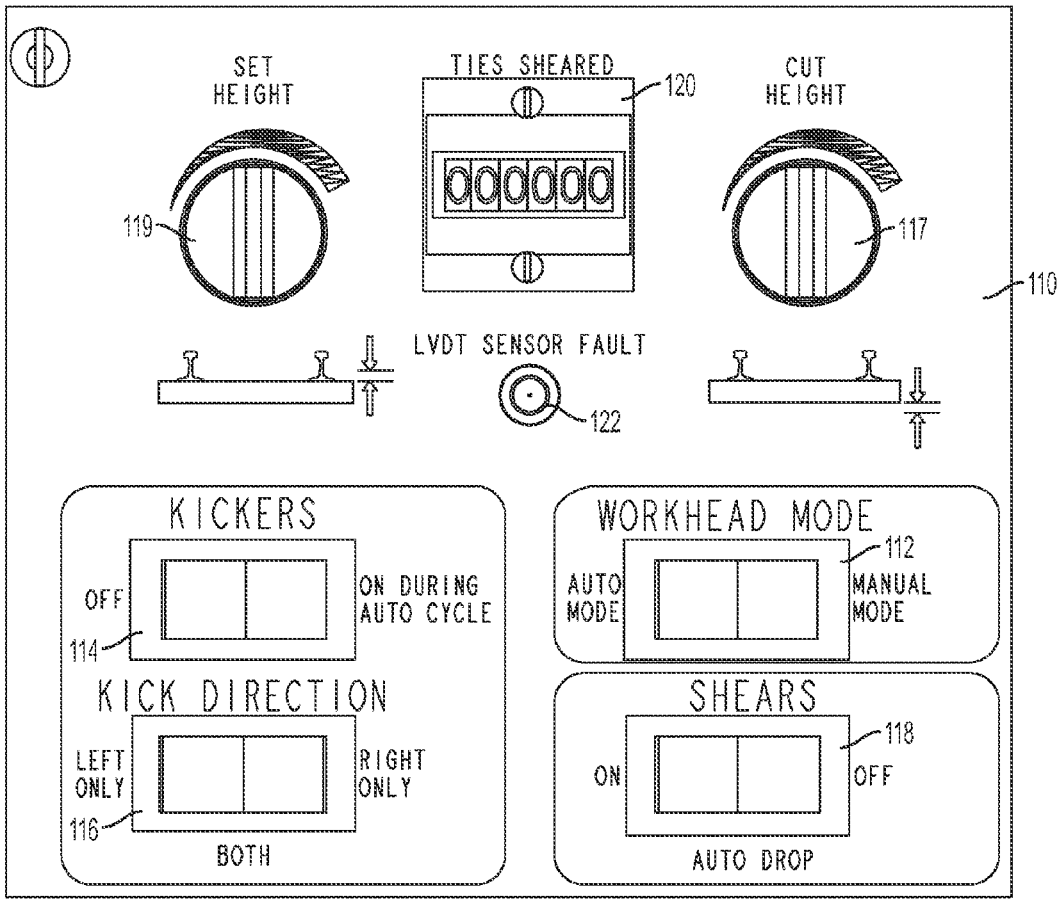
FIG. 24 is an example of an upper control panel for the present railroad tie removal machine.

More specifically, in one embodiment, the control unit 100 is programmed to operate in either a manual mode, whereby the operator manually controls the tie shear workhead 40 and the kicker workhead 70 via manual controls. FIG. 24 shows one example of an upper control panel 110, which includes various switches and other controls, such as a workhead mode switch 112, which is two position switch used for selecting either automatic (auto) mode or manual mode; a switch 114 is a two position switch for selecting whether the kickers are to be activated (on) during the on auto cycle, or whether they remain off (such as where obstructions may prevent safer or effective kickout of the tie outer portions 50); and a switch 116, which is a three position switch for selecting whether the kick direction is left only (i.e., only the left kicker operates); right only (i.e., only the right kicker operates); or both (both kickers operate), which selection can be made by the operator based on, for example, the existence or non-existence of obstructions adjacent the tie outer portions 50. The upper panel 110 of FIG. 24 also preferably includes a two position switch 118 for controlling whether the shears automatically drop the cut center portion 48 of the tie or whether the operator controls the timing of the drop. Other controls or indicators on the upper panel 110 can include, for example, dials 117 and 119 for setting the set height and the cut height, respectively, as well as a counter 120 for counting the number of ties that have been sheared (to help estimate when blades 43 need to be replaced or sharpened), and an indicator 122 for showing when there is a fault related to one of the linear variable differential transformers (LVDTs), which LVDTs will be discussed below.

Figure 25:
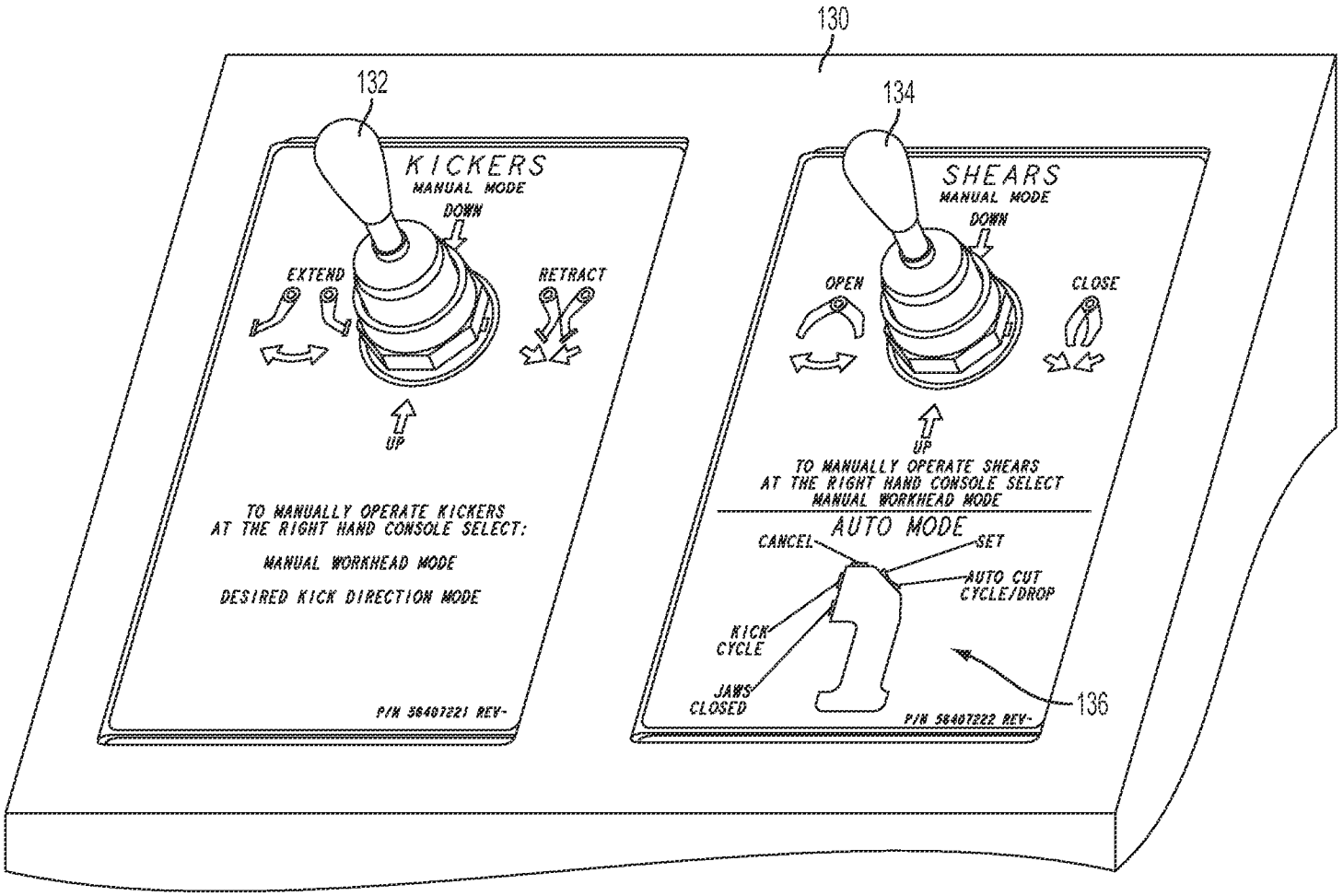
FIG. 25 is an example of a lower control panel for the present railroad tie removal machine.
Figure 26A:
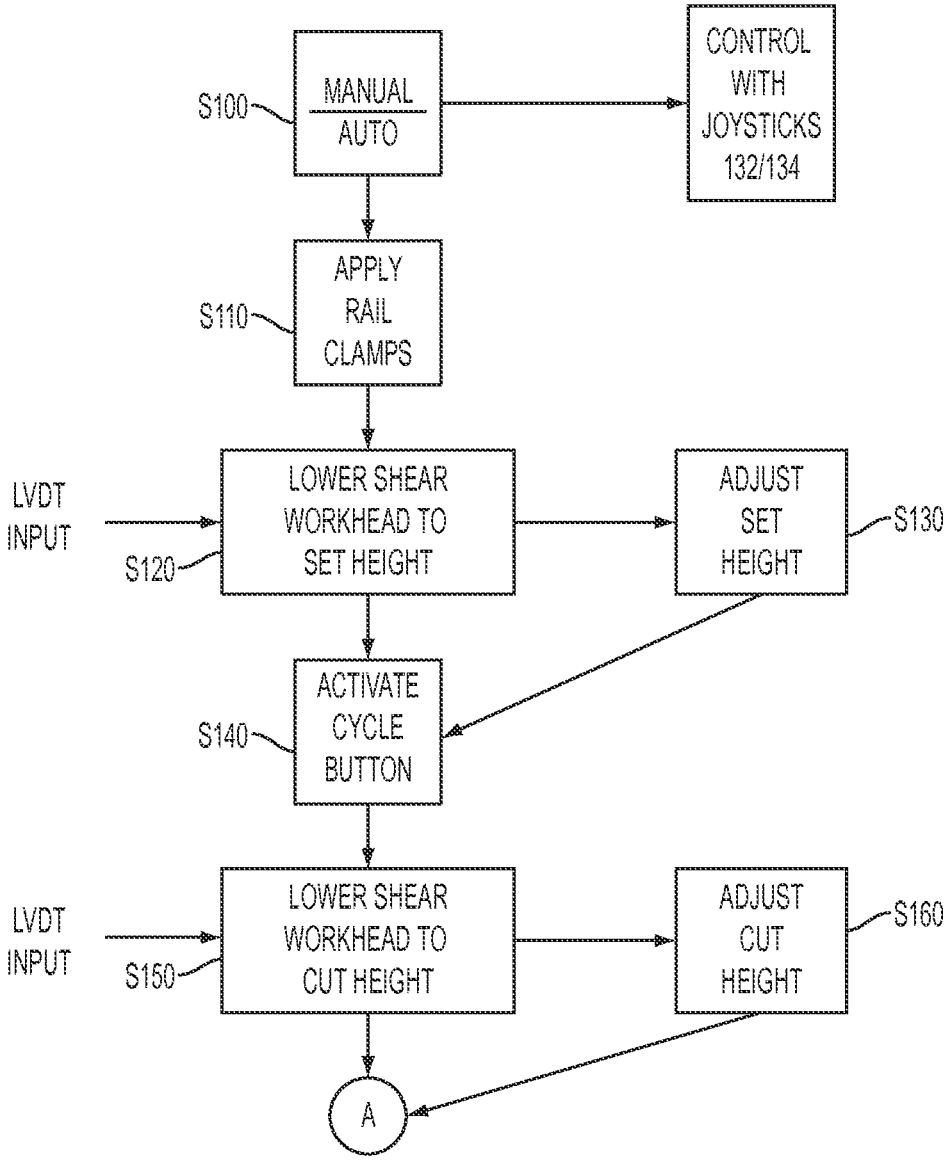
FIGS. 26A-26D provide an example of a flowchart of the automatic control steps for the present railroad tie removal machine.
Figure 26B:
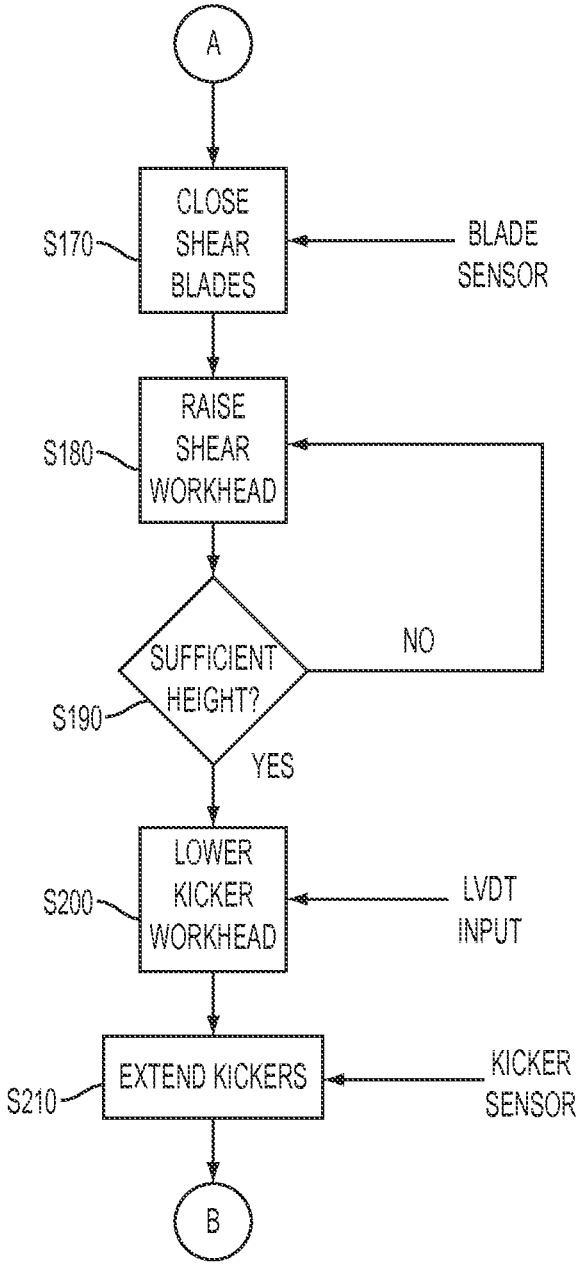
Figure 26C:
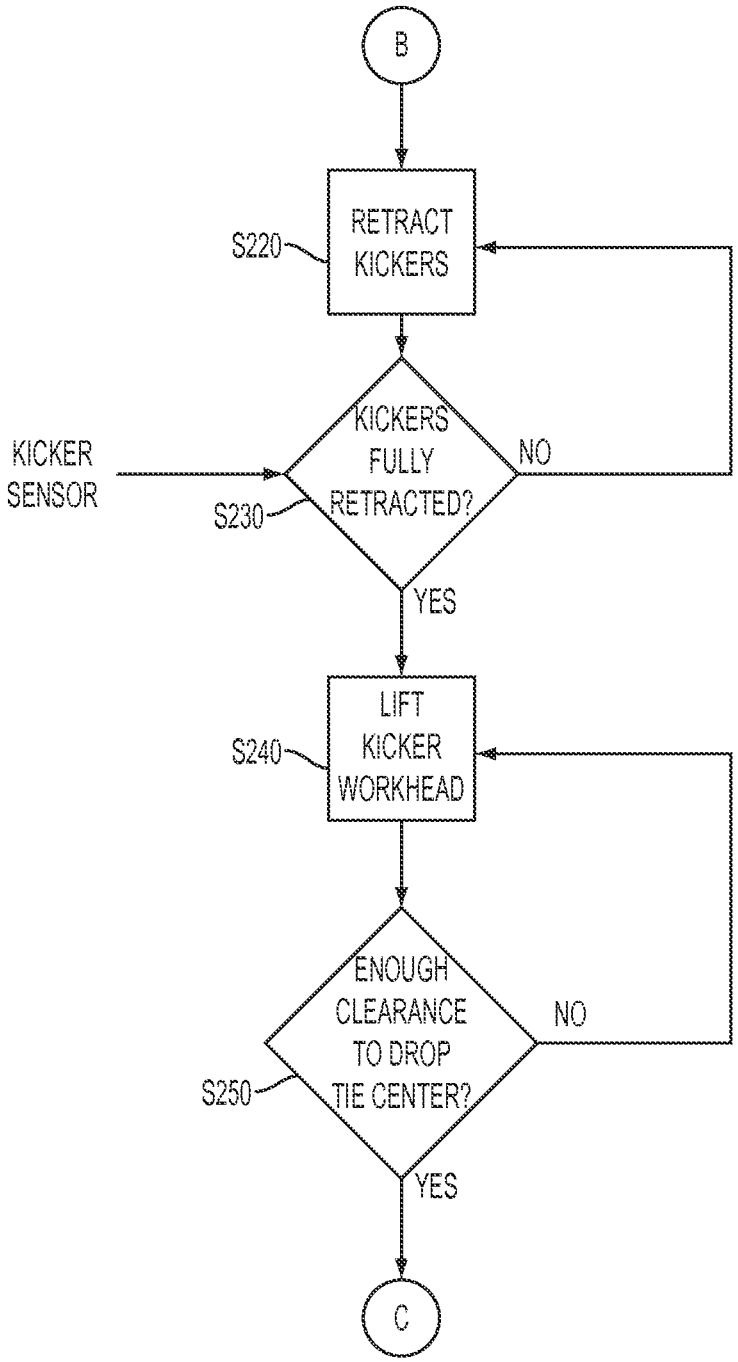
Figure 26D:
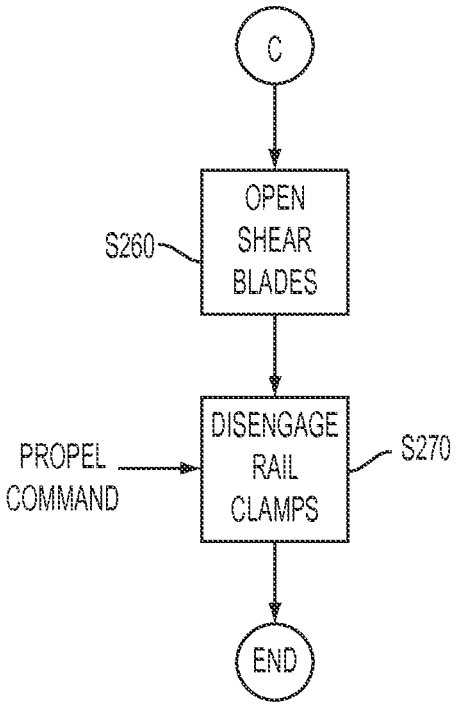

FIG. 25 shows one example of a lower control panel 130. In this embodiment, the kickers can be controlled, when in manual mode, via joystick 132, for up and down movement, as well as between extending (one or both kickers outward for kickout) and retracting. A joystick 134 is used for controlling the shears, when in manual mode, for up/down movement, as well as for selecting between open and close (i.e., cutting). Both joysticks 132, 134 are preferably dual axis with four positions, although other configurations are also contemplated.

FIG. 25 also shows how this control panel includes a representation 136 of a hand controller (not shown) to provide the operator with guidance for the controls on the hand controller that is used during auto mode. Of course, other configurations, control types, and control layouts besides those of FIGS. 24 and 25 are also contemplated.

One of the buttons on the hand controller in representation 136 is the "set" button, which activates a process for setting the "set height" and the "cut height" of the shear workhead 40 (where the "set height" is a few inches above the tie, and the "cut height" is the height at which the blades 43 can cut completely through the tie). The "set height" and "cut height" are set in advance of initiating the auto cut cycle. Depressing the "set" button starts the following sequence: the shear workhead 40 is lowered to the previously set or default position, and the control unit 100 waits for further input/instructions. At this point, the operator can: (i) reposition the tie removal machine 10, if needed; (ii) increase/decrease the set height via the set height dial 119 (FIG. 24); (iii) start the auto cycle by depressing the "auto cut cycle/drop" button depicted in representation 136 (FIG. 25) of the hand controller; or (iv) cancel the process by depressing the "cancel" button on the hand controller. As explained more fully below, once the operator presses the "auto cut cycle/drop" button (FIG. 25), the automatic cycle proceeds without any operator input or feedback (unless the "auto drop" button 118 (FIG. 25) is set to "OFF," in which case the operator does need to depress the "auto cut cycle/drop" button again near the end of the process to release the cut center tie section from the shear workhead 40).

Some examples of the various available work cycles will be described next, while referring to FIGS. 26A-26D, which is a flow chart for explaining one embodiment of the normal fully automatic cycle, while also referring to FIGS. 24 and 25. Under the "Normal Fully Automatic Cycle," the following takes place:

- Block S100: The Operator presses the workhead mode set button 112 to choose the auto mode.
  - Block S110: A set of rail clamps apply to lock the tie removal machine 10 in position upon the track.
  - Block S120: Using feedback from a position sensor (such as an LVDT in the shear up/down cylinder 59), the shear workhead 40 lowers to the default set height position, which is a few inches above the tie 13'. In this position, the operator has a better perspective view of the tie 13', and can assure that the machine 10 is properly positioned over the tie. At this point, the operator can move the machine 10 forward or backward, if needed.
  - If the set height needs to be adjusted, the operator adjusts the height via dial 119 in Block S130. Once adjusted, the process proceeds to block S140. If no adjustment is necessary, the process proceeds directly from Block S120 to Block S140.
- Block S140: The Operator presses the cycle button (labeled "AUTO CUT CYCLE/DROP") on the hand controller depicted in representation 136.
  - Block S150: The Shear workhead 40 lowers to the cut depth (using feedback from the position sensor, such as the LVDT).
  - The cut height is to be adjusted prior to starting the automatic cycle. The operator adjusts the height via dial 117 (FIG. 24) in Block S160. Once the shear reaches the cut height set in Block S160, the process proceeds to block S170.
  - Block S170: The shear blades 43 of the shear blade workhead 40 are closed.
  - Blade sensors provide feedback to the controller once the blades 43 of the shear workhead 40 are completely closed, allowing the process to continue to block S180.
  - Block S180: The shear workhead 40 is raised to a height that is sufficient to provide clearance for the kicker workhead 70 to be lowered into position, as determined in Block S190. The freshly cut center portion 48 of the tie 13' is lifted with the shear workhead 40.
  - Once the shear workhead 40 is clear, the tie kicker workhead 70 is lowered into position, as indicated in Block S200. The tie kicker workhead 70 also contains an LVDT, or other linear displacement sensor, in the kicker up/down cylinder 88. The feedback from the sensor is used to assure that the kicker workhead 70 and the shear workhead 40 do not collide with each other, and it also assures it is safe to extend the kickers 72 without striking the rails 14 and 16.
  - Block S210: Once the kickers 72 are extended to a position below the rails 14/16, the kickers are extended.
  - Sensors on each kicker 72 provide feedback to the controller to indicate the kickers are fully extended.
  - Block S220: the kickers 72 are retracted.
  - Block S230: Sensors on each kicker arm provide feedback to the controller to indicate that the kickers 72 are fully retracted. If not, the process returns to Block S220 to continue retracting the kickers. The kicker workhead 70 should not be lifted unless the kickers 72 are fully retracted, otherwise the kickers will catch the rails 14, 16.
  - Block S240: Once determined in Block S230 that the kickers 72 are fully retracted, the kicker workhead 72 is lifted toward the frame 32.
  - Once the kicker workhead 72 has retracted far enough to be cleared by the center portion 48 of the tie being dropped by the shear workhead 40, as indicated in Block S250, the shear blades open (Block S260), and the center portion 48 of the cut tie 13' drops back to the track bed.
  - Block S270: When the operator give the propel command to propel the machine 10 to the next position, the rail clamps retract.

In addition to the "Normal Fully Automatic Cycle," there are also numerous variations in to this fully automatic mode, such as the following:

- Auto Drop Off Mode
  - Auto Drop On mode is what is described above in the "Normal Fully Automatic Cycle." In contrast, in Auto Drop Off mode, the shears 42 do not open to drop the center tie section until the operator presses the cycle button again.
  - The Auto Drop Off mode gives the Operator the option to propel the machine 10 and drop the cut center portion 48 of the tie at another position that is different than where it was extracted from.
  - The Auto Drop Off mode can also give the operator time to assure the tie outer portions 50 have been satisfactorily kicked out from under the rails 14, 16 before the center portion 48 is dropped down, possibly in the way of the kicker workhead 70.

In this mode, if the center portion 48 of the cut tie 13' has not been dropped by the shear head 40 yet, the operator can repeat the kick cycle via a button on the hand controller (FIG. 15, represented at 136), to push out again against stubborn outer tie sections 50.

Kickers Off During Auto Cycle Mode

Kickers On During Auto Cycle mode is what is described above in the "Normal Fully Automatic Cycle."

The Kickers Off mode provides an automatic cycle where the kicker portions of the cycle (such as Blocks S200 to S250) are skipped.

This mode is useful in areas where obstructions are present, such that kicking out the outer portions 50 of the cut tie is undesirable.

Kick Direction Left Only/Both/Right Only Modes

Kick Direction Both mode is what is described above in the "Normal Fully Automatic Cycle."

When in Left Only mode, the left kicker operates and the right kicker stays retracted during the cycle.

When in Right Only mode, the right kicker operates and the left kicker stays retracted during the cycle.

The left only and right only modes are useful in areas where obstructions are present, such that kicking out one of the outer portions 50 of the cut tie is undesirable.

Left Only/Both/Right Only also applies when the Manual Mode is selected.

Auto Mode vs. Manual Mode

Auto Mode is what is described above as the "Normal Fully Automatic Cycle," with the other variations. This mode includes all controls where one input from the operator results in multiple output sequences performed via the Programmable Logic Controller (PLC). An ergonomic hand controller (136) with a number of buttons (such as 5) is enabled, and the joysticks 132, 134 are disabled.

In Manual Mode, the hand controller (136) is disabled, and the joysticks 132, 134 are enabled.

The Manual Mode will be useful for troubleshooting or to operate the machine in the event of a sensor failure.

While particular embodiments of the railroad tie removal machine and methods of removing railroad ties have been shown and described, it will be appreciated by those skilled in the art that changes and modifications may be made thereto without departing from the invention in its broader aspects and as set forth in the following claims.

The invention claimed is:

1. A method for removing a railroad tie from beneath a pair of spaced rails of a railroad track using a tie removal machine, wherein the tie removal machine includes a tie shear workhead and a kicker workhead, the method comprising:

positioning the railroad tie removal machine on the railroad track such that the tie shear workhead is aligned above the tie to be removed;

activating the tie shear workhead to cut the tie being removed; and after completing the step of activating the tie shear workhead, but without re-positioning the tie removal machine with respect to the railroad track, performing a step of activating the kicker workhead to kick out the tie being removed, which has now been cut, from below the rails.

2. The method according to claim 1, wherein said step of activating the tie shear workhead comprises:

lowering the tie shear workhead from a rest position; and shearing the tie being removed at both a first cut location and a second cut location, wherein said first and second cut locations are both between the pair of rails, whereby said first and second cut locations divide the tie into a center portion and two outer portions.

3. The method according to claim 2, wherein said step of activating the tie shear workhead comprises simultaneously shearing the tie at both said first location and said second location.

4. The method according to claim 2, wherein after said step of activating the tie shear workhead, performing a step of raising said tie shear workhead back to the rest position.

5. The method according to claim 4, wherein the step of activating the kicker workhead comprises:

lowering the kicker workhead from a rest position; and using a pair of kickers to outwardly kick the two outer portions of the cut tie from under the associated rails.

6. The method according to claim 5, wherein:

said step of lowering said tie shear workhead from a rest position involves moving said tie shear workhead along a tie shear axis, said step of lowering said kicker workhead from a rest position involves moving said kicker workhead along a kicker axis, and said tie shear axis is oblique with respect to said kicker axis.

7. The method according to claim 6, wherein said tie shear axis is generally vertical with respect to the rails of the railroad track.

8. The method according to claim 4, wherein said step of activating the tie shear workhead comprises selecting between a first mode in which the center portion of the cut tie is automatically dropped from said tie shear workhead after said step of raising said tie shear workhead back to the rest position and a second mode in which an operator manually controls when the center portion of the cut tie is dropped from said tie shear workhead after said step of raising said tie shear workhead back to the rest position.

9. The method according to claim 1, wherein said step of activating the kicker workhead comprises:

selecting from one of the following modes: (i) left kicker only; (ii) right kicker only; or (iii) both left kicker and right kicker;

operating only a left kicker of the kicker workhead when the left kicker only mode has been selected;

operating only a right kicker of the kicker workhead when the right kicker only mode has been selected; and operating both the left and right kickers of the kicker workhead when the both left kicker and right kicker mode has been selected.

10. The method according to claim 1, further comprising:

selecting between a manual mode and an automatic mode;

wherein when said manual mode is selected, an operator controls if and when the step of activating the tie shear workhead and the step of activating the kicker workhead are performed, and wherein when said automatic mode is performed, the step of activating the tie shear workhead and the step of activating the kicker workhead are performed automatically, without further input from an operator.

11. The method according to claim 1, wherein said step of activating the tie shear workhead comprises:

using a first pair of shears to cut the tie being removed at a first cut location;

using a second pair of shears to cut the tie being removed at a second cut location, wherein said second cut location is different from said first cut location, and further wherein said first and second cut locations are both located within a workspace defined between a pair of spaced rails, whereby said first and second cut locations divide the tie into a center portion and two outer portions.

12. The method according to claim 11, wherein said step of activating the kicker workhead comprises using at least one kicker to outwardly kick a corresponding outer portion of the cut tie from under the associated rail, wherein the outer portion of the cut tie is located within said workspace, and further wherein both said first and second pairs of shears and said at least one kicker acts on said workspace sequentially without moving the tie removal machine relative to the railroad track.

13. The method according to claim 12, wherein said kicker workhead includes a pair of kickers, and further wherein a first one of said kickers outwardly kicks a first one of said outer two portions of the cut tie and a second one of said kickers outwardly kicks a second one of said two outer portions of the cut tie.

14. An automatic method for removing a railroad tie from beneath a pair of spaced rails of a railroad track using a tie removal machine, wherein the tie removal machine includes a tie shear workhead and a kicker workhead, the method comprising:

applying a set of rail clamps to lock the tie removal machine in a first position upon the railroad rack;

lowering the tie shear workhead, and then closing at least one pair of shear blades of the tie shear workhead to thereby cut the tie being removed;

raising the tie shear workhead to a height that is sufficient to provide clearance for the kicker workhead to be lowered into position;

after completing the step of raising the tie shear workhead, but without re-positioning the tie removal machine from the first position, performing a step of lowering the kicker workhead;

extending at least one kicker of the kicker workhead to kick out at least one portion of the tie being removed;

retracting the at least one kicker;

raising the kicker workhead to a rest position; and unlocking the set of rail clamps, and moving the tie removal machine from the first position to a second position upon the railroad rack.

15. The automatic method according to claim 14, wherein:

said step of lowering said tie shear workhead involves moving said tie shear workhead along a tie shear axis, said step of lowering said kicker workhead involves moving said kicker workhead along a kicker axis, and said tie shear axis is oblique with respect to said kicker axis.

16. The automatic method according to claim 14, wherein said step of extending at least one kicker involves extending a pair of kickers.

17. The automatic method according to claim 16, further comprising:

selecting from one of the following modes: (i) left kicker only; (ii) right kicker only; or (iii) both left kicker and right kicker;

operating only a left kicker of the kicker workhead when the left kicker only mode has been selected;

operating only a right kicker of the kicker workhead when the right kicker only mode has been selected; and operating both the left and right kickers of the kicker workhead when the both left kicker and right kicker mode has been selected.

* * * * *